US009776417B2

(12) United States Patent
Koizumi et al.

(10) Patent No.: US 9,776,417 B2
(45) Date of Patent: Oct. 3, 2017

(54) CARTRIDGE AND LIQUID EJECTION APPARATUS

(71) Applicant: Seiko Epson Corporation, Tokyo (JP)

(72) Inventors: Yoshihiro Koizumi, Shiojiri (JP); Hiroyuki Nakamura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/080,670

(22) Filed: Mar. 25, 2016

(65) Prior Publication Data

US 2016/0288512 A1 Oct. 6, 2016

(30) Foreign Application Priority Data

Mar. 30, 2015 (JP) ..... 2015-067811

(51) Int. Cl.
*B41J 2/175* (2006.01)
*B41J 29/13* (2006.01)

(52) U.S. Cl.
CPC ..... *B41J 2/1752* (2013.01); *B41J 2/17513* (2013.01); *B41J 2/17523* (2013.01); *B41J 2/17553* (2013.01); *B41J 29/13* (2013.01)

(58) Field of Classification Search
CPC ..... B41J 2/1752
See application file for complete search history.

(56) References Cited

U.S. PATENT DOCUMENTS

2007/0176988 A1 8/2007 Nakamura et al.
2008/0049083 A1* 2/2008 Ishizawa ..... B41J 2/1755 347/86

FOREIGN PATENT DOCUMENTS

JP 2007-203541 A 8/2007

* cited by examiner

*Primary Examiner* — Alessandro Amari
*Assistant Examiner* — Roger W Pisha, II
(74) *Attorney, Agent, or Firm* — Workman Nydegger

(57) ABSTRACT

Accuracy in determination of the attaching direction of an elongated cartridge is improved. A cartridge 4A according to this embodiment to be attached to a printer includes an ink supply port 414 that supplies ink to the printer, a misinsertion prevention upper face projection portion 140 that engages with misinsertion prevention portions 671 of a misinsertion prevention plate 160 in a cartridge attachment portion 6, and restriction front upper face projection portions 430 that abut against a first guide rail 650 and a first guide rail 651 and restrict a tilt of the cartridge in an intersecting direction that intersects the attaching direction at the time of attachment. These restriction front upper face projection portions 430 are arranged between a leading end side in the attaching direction CS and the misinsertion prevention upper face projection portion 140.

23 Claims, 14 Drawing Sheets

CARTRIDGE AND LIQUID EJECTION APPARATUS

CROSS-REFERENCE TO RELATED APPLICATION

This application claims priority under 35 U.S.C. §119 on Japanese Patent Application No. 2015-067811, filed Mar. 30, 2015. The content of this priority application is incorporated by reference in its entirety.

BACKGROUND

1. Technical Field

The present invention relates to cartridges and liquid ejection apparatuses.

2. Related Art

Regarding a cartridge capable of supplying liquid to a liquid ejection apparatus, a mode of supplying ink to a printer, which is an example of a liquid ejection apparatus, has been hitherto known. A large flow of ink needs to be supplied in a printer capable of high-speed printing, a so-called line printer in which a plurality of ink ejection heads are linearly arranged, and the like. For this reason, an elongated cartridge having a suppressed height and a long depth has been proposed in order to contain a large amount of ink while avoiding an increase in the size of the apparatus (e.g., JP-A-2007-203541).

With this kind of elongated cartridge, when attaching the cartridge to a printer, the position of the leading end thereof in the attaching direction is significantly changed by a slight tilt of the hand due to the long length of the cartridge. Such a position shift can be suppressed by making the width of a guide rail of a cartridge holder into which the cartridge is inserted the same as the width of the cartridge, but then the cartridge can slide less smoothly, resulting in difficulty of insertion. For this reason, a certain gap needs to be secured between the cartridge and the guide rail thereof. Meanwhile, a cartridge holder is provided with a misinsertion prevention key (misinsertion prevention portion) for preventing misinsertion due to inserting a cartridge of an incorrect color or the like. For this reason, in the case where the aforementioned gap is not appropriately secured, there is a concern that even if a correct cartridge is inserted, this cartridge interferes with the misinsertion prevention key of the cartridge holder, and the cartridge cannot be smoothly attached. It is desired that not only elongated cartridges but also short cartridges can be smoothly attached.

SUMMARY

In view of the foregoing situation, a problem for the invention lies in an increase in attachability of cartridges.

The invention has been made in order to solve at least a part of the foregoing problem, and can be achieved in the following modes.

(1) According to an aspect of the invention, a cartridge is provided.

This cartridge is a cartridge configured to be attached to a liquid ejection apparatus having a holder to which the cartridge is to be attached, a guide rail that is provided in the holder and guides attachment of the cartridge, and an apparatus-side misinsertion prevention portion that prevents misinsertion of the cartridge, the cartridge including: a liquid supply port for supplying liquid to the liquid ejection apparatus; a misinsertion prevention portion that engages with the apparatus-side misinsertion prevention portion; and a restriction portion that abuts against the guide rail and restricts a tilt of the cartridge in an intersecting direction that intersects an attaching direction at the time of attachment, wherein the restriction portion is arranged between a leading end side in the attaching direction and the misinsertion prevention portion.

With the cartridge in this mode, only the restriction portion is caused to abut against the guide rail, and it is accordingly possible to appropriately set a gap with respect to the guide rail, and adequate slidability is secured. Also, as a result of the restriction portion abutting against the guide rail, a tilt of the cartridge is restricted when the cartridge is attached, and the positional relationship between the apparatus-side misinsertion prevention portion and the misinsertion prevention portion can be secured. As a result, with the cartridge in this mode, the cartridge can be smoothly attached, and the attachability is improved.

(2) In the cartridge in the above-described mode, the misinsertion prevention portion may be arranged on the leading end side in the attaching direction. With this configuration, erroneous attachment can be prevented before the liquid supply port of the cartridge is connected to the liquid ejection apparatus.

(3) In the cartridge in the above-described mode, the restriction portion may be arranged at a position closer to the misinsertion prevention portion than to the liquid supply port. With this configuration, even if the attached cartridge tilts, a shift of the misinsertion prevention portion due to the tilt is reduced as a result of the restriction portion and the misinsertion prevention portion being arranged close to each other. It is accordingly possible to reduce the risk of the misinsertion prevention portion interfering with the apparatus-side misinsertion prevention portion without engaging therewith.

(4) In the cartridge in the above-described mode, the restriction portion may be a projection portion provided in a face different from a face in which the misinsertion prevention portion is provided. With this configuration, a rattling can be more reliably suppressed by the projection portion serving as the restriction portion. As a result, with the cartridge in this mode, a situation can be avoided where the misinsertion prevention portion interferes with the apparatus-side misinsertion prevention portion without engaging therewith, and adequate slidability can be secured. Therefore, the cartridge can be smoothly attached, and the attachability is further improved.

(5) In the cartridge in the above-described mode, the misinsertion prevention portion may be arranged in an upper face on a vertically upper side, and the restriction portion may be arranged in a side face parallel with the attaching direction. With this configuration, a tilt of the cartridge in the width direction can be suppressed.

(6) In the cartridge in the above-described mode, the restriction portion may be arranged at a corner portion at which the upper face intersects the side face. With this configuration, a tilt of the cartridge in the width direction can be suppressed.

(7) In the cartridge in the above-described mode, the misinsertion prevention portion may be arranged in a lower face on a vertically lower side, and the restriction portion may be arranged in a side face parallel with the attaching direction. With this configuration, a tilt of the cartridge in the width direction can be suppressed.

(8) In the cartridge in the above-described mode, the restriction portion may be arranged at a corner portion at which the lower face intersects the side face. With this configuration, a tilt of the cartridge in the width direction can be suppressed.

(9) In the cartridge in any of the above-described modes, a rear restriction portion that restricts a tilt of the cartridge in the intersecting direction may be arranged in a lower face located on a vertically lower side, and on a trailing end side in the attaching direction. With this configuration, the risk of occurrence of liquid leakage and a contact failure of a terminal is reduced by suppressing a tilt of the cartridge along the vertical direction, as well as restricting the tilt using the restriction portion on the side of the attachment end.

(10) According to another mode of the invention, a liquid ejection apparatus is provided. Since this liquid ejection apparatus includes the cartridge in any of the already-described modes, the attachability of the cartridge is improved.

Not all of a plurality of constituent components provided in the above-described modes of the invention are essential, and some of the plurality of constituent components may be modified, deleted, or replaced with a new constituent component, or the content of limitation may be partially deleted as appropriate, in order to solve a part of or the entire problem described above, or to achieve some or all of the effects described in this specification. It is also possible to combine some or all of the technical features included in one of the above-described modes of the invention with some or all of the technical features included in the other of the above-described modes of the invention to make an independent mode of the invention, in order to solve a part of or the entire problem described above, or to achieve some or all of the effects described in the specification.

The invention can also be achieved in various modes. For example, the invention can be achieved in the modes such as a liquid supply system that supplies liquid from a cartridge to a liquid ejection apparatus and a system including a cartridge and a liquid ejection apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, an embodiment of the invention will be described in the following order.

Figure 1:
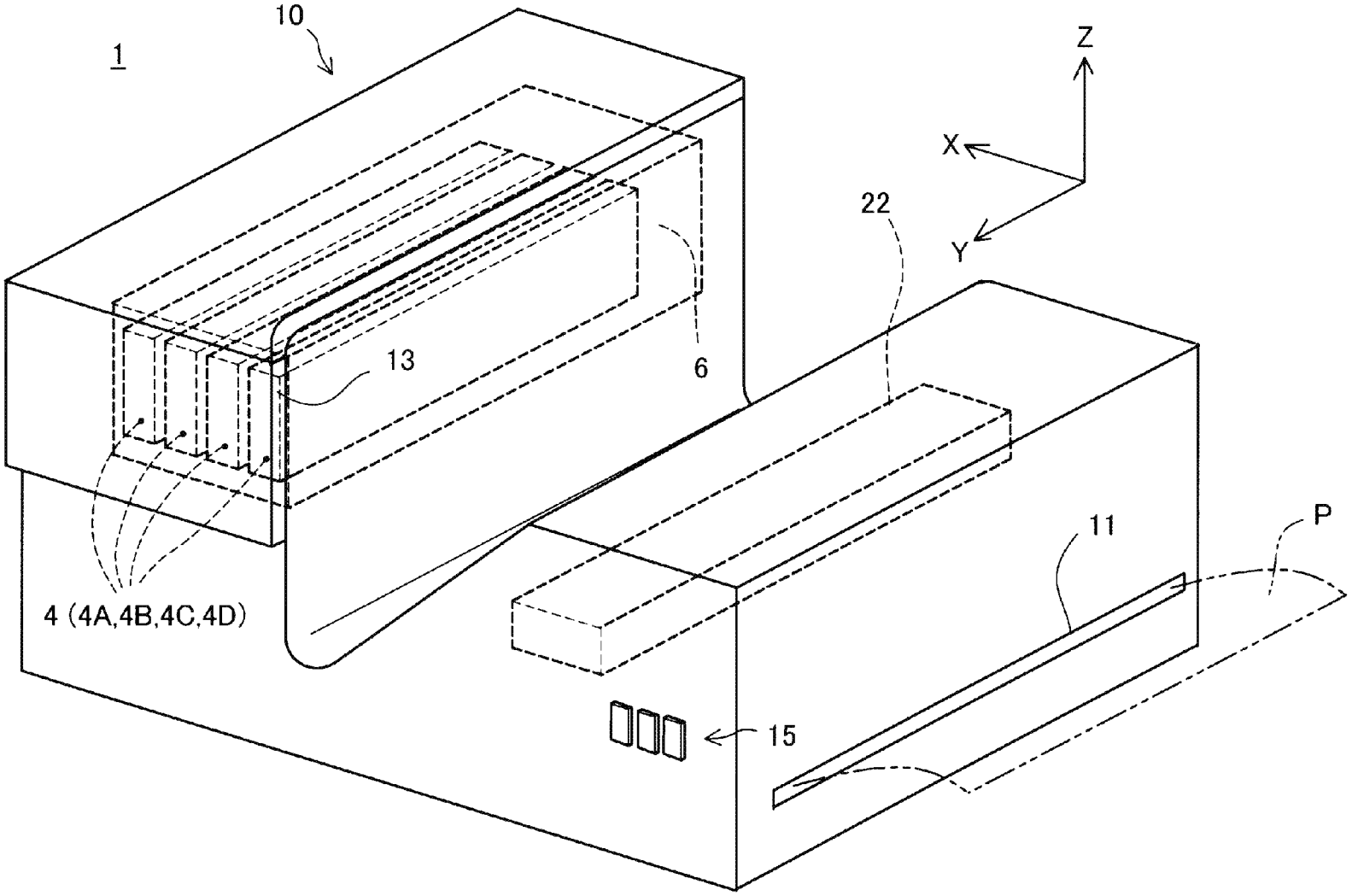
FIG. 1 is a perspective view showing a schematic configuration of a printing material supply system 1.

A. Embodiment:

B. Various modifications:

A. Embodiment:

A-1: Configuration of Printing Material Supply System:

FIG. 1 is a perspective view showing a schematic configuration of a printing material supply system 1. The printing material supply system 1 includes a plurality of cartridges 4, and a printer 10, which serves as a liquid ejection apparatus. In the printing material supply system 1, the cartridges 4 are individually and detachably attached to a cartridge attachment portion 6 of the printer 10. Note that X, Y, and Z axes shown in FIG. 1 that are orthogonal to one another will be used as appropriate in the following descriptions of the shape of constituent members of the cartridge attachment portion 6 and the cartridge 4, positional relationships therebetween, and the like.

The printer 10 according to this embodiment is an inkjet line printer that discharges ink, which serves as liquid, from a line head 22. The line head 22 has ink ejection holes for ink of respective colors, which are black, yellow, magenta, and cyan, linearly arranged in a Y-axis direction in FIG. 1, and includes multiple linear ink ejection hole lines for the respective colors arranged in an X-axis direction in FIG. 1. Operation buttons 15 are arranged in a front face of the printer 10. The printer 10 ejects ink from the line head 22 to perform printing while conveying, in a −X direction, printing paper P contained in a paper tray (not shown) in a printer housing, and discharges printed printing paper P from a discharge hole 11, in accordance with a printing instruction given through button operations by a user. Note that sheet conveyance and printing operations are not different from those of normal line printers and do not directly relate to the gist of the invention. Accordingly, descriptions thereof will be omitted.

The plurality of cartridges 4 are individually and detachably attached to the cartridge attachment portion 6. In this embodiment, four types of cartridge 4 are provided in association with four colors (black, yellow, magenta, and cyan) of ink in one-to-one correspondence, i.e., a total of four cartridges 4 are attached to the cartridge attachment portion 6. The printer 10 according to this embodiment is provided with a replacement cover 13 in the front face (a face located on the side in a +Y-axis direction) of the printer 10. If the side of the replacement cover 13 in a +Z-axis direction is moved toward the proximal, front side (the side in the +Y-axis direction), an opening of the cartridge attachment portion 6 appears, and then the cartridges 4 can be attached and detached. In the printer 10 according to this embodiment, since a large amount of black ink is used, the capacity of a cartridge 4 for containing the black ink is increased by increasing the thickness thereof, compared with cartridges 4 for containing ink of the other colors. In the following description, when necessary, the cartridge 4 having the increased capacity will be referred to as a cartridge 4A, and the other cartridges 4 will be distinguished by referring to them as cartridges 4B, 4C, and 4D. Each of the cartridges 4 will be referred to as the cartridge 4 when collectively describing them.

Upon the cartridges 4 being attached to the cartridge attachment portion 6, ink can be supplied to the line head 22 via a tube (not shown). In this embodiment, ink is supplied by absorbing the ink in the cartridges 4 using a pump mechanism (not shown) in the printer 10. Note that an ink absorption tube is provided for each type of the ink. Here, a state where the cartridges 4 are attached to the cartridge attachment portion 6 will also be called an "attached state". Note that attachment of the cartridges 4 to the cartridge attachment portion 6 and a detailed configuration of the cartridges 4 and the cartridge attachment portion 6 will be described later.

In this embodiment, in a state where the printing material supply system 1 is in use, the axis along the conveyance direction of the printing paper P will be deemed to be an X axis, the axis along the gravity direction (up-down direction) will be deemed to be a Z axis, and the axis along the longitudinal direction (left-right direction) of the linear head will be deemed to be a Y axis. Here, "a state where the printing material supply system 1 is in use" refers to a state where the printing material supply system 1 is installed on a horizontal surface. Also, in this embodiment, the conveyance direction (forward direction) will be deemed to be a −X-axis direction, the direction opposite thereto (rearward direction) will be deemed to be a +X-axis direction, the direction extending upward from below in the gravity direction (upward direction) will be deemed to be a +Z-axis direction, and the direction opposite thereto (downward direction) will be deemed to be a −Z-axis direction. When viewing the printing material supply system 1 from the front side (the side in the +Y-axis direction), the direction extending from the right side to the left side will be deemed to be the +X-axis direction, and the direction opposite thereto will be deemed to be the −X-axis direction. Also, in this embodiment, the attaching direction when the cartridges 4 are attached to the cartridge attachment portion 6 is a −Y-axis direction, and the direction in which the cartridges 4 are removed from the cartridge attachment portion 6 is a +Y-axis direction. Accordingly, the side of the cartridge attachment portion 6 in the −Y-axis direction will also be called an attachment distal, rear side, and the side thereof in the +Y-axis direction will also be called an attachment proximal, front side. Also, in this embodiment, the arrangement direction of the plurality of cartridges 4 in the cartridge attachment portion 6 is the X-axis direction. The X, Y, and Z axes that are associated with the constituent members in this manner are also given in the subsequent drawings, and the X, Y, and Z axes in FIG. 1 also correspond respectively to the X, Y, and Z axes in the other drawings.

Figure 2:
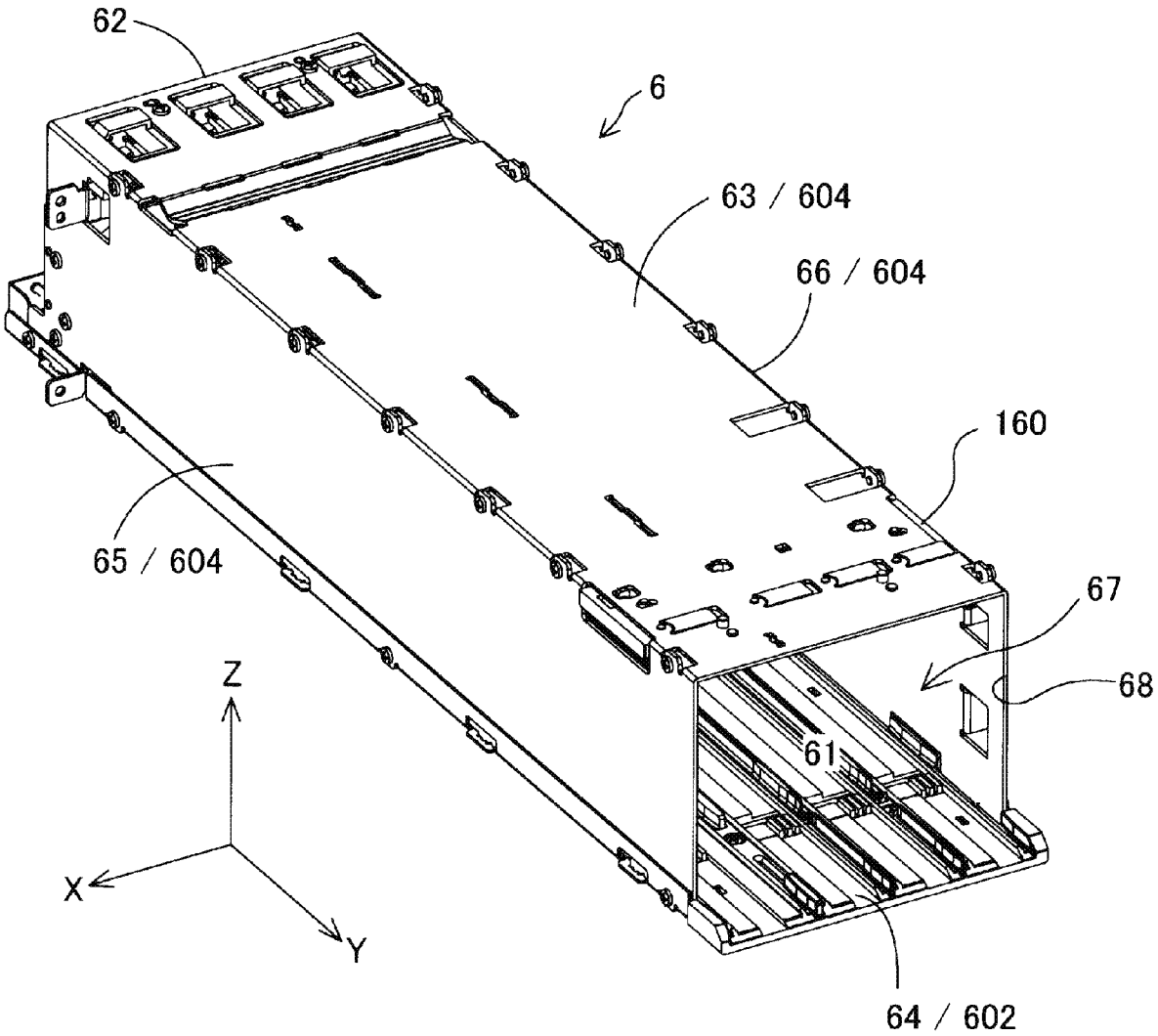
FIG. 2 is a perspective view of an appearance of a cartridge attachment portion 6.

A-2: Detailed Configuration of Cartridge Attachment Portion:

Next, a detailed configuration of the cartridge attachment portion 6 will be described. FIG. 2 is a perspective view of an appearance of the cartridge attachment portion 6, and FIG. 3 is a perspective view of the cartridge attachment portion 6 with a cover member removed.

As shown in the diagrams, the cartridge attachment portion 6 includes an attaching mechanism portion 8 (see FIG. 3) and a plate 602 in a continuous manner, and these members are an assembled item covered with a cover member 604. The cartridge attachment portion 6 also includes a misinsertion prevention plate 160 integrated with the cover member 604, the misinsertion prevention plate 160 being opposed to the plate 602. Integration of the misinsertion prevention plate 160 will be described later. In a state where the cartridge attachment portion 6 is integrated with the printer 10, the attaching mechanism portion 8 is located on the attachment distal, rear side (the side in the −Y-axis direction), and the plate 602 extends from the attaching mechanism portion 8 to the attachment proximal, front side (the side in the +Y-axis direction). The plate 602 and the cover member 604 demarcate and form a cartridge containing chamber 61. The cartridge containing chamber 61 forms a rectangular-parallelepiped shape, and is surrounded by a first wall 62 on the side of the attaching mechanism portion 8, a second wall 63 constituted by the cover member 604 and extending in a container chamber upper face from the first wall 62 toward the other end side, a third wall 64 constituted by the plate 602 and extending in a container chamber lower face from the first wall 62 toward the other end, a fourth wall 65 that is an elongated side face constituted by the cover member 604, and a fifth wall 66 that is the other elongated side face constituted by the cover member 604. The side of the sixth wall 67 opposed to the first wall 62 is provided as a cartridge attaching port 68. In the diagram, for example, "63/604" indicates that the second wall 63 is constituted by the cover member 604.

Figure 3:
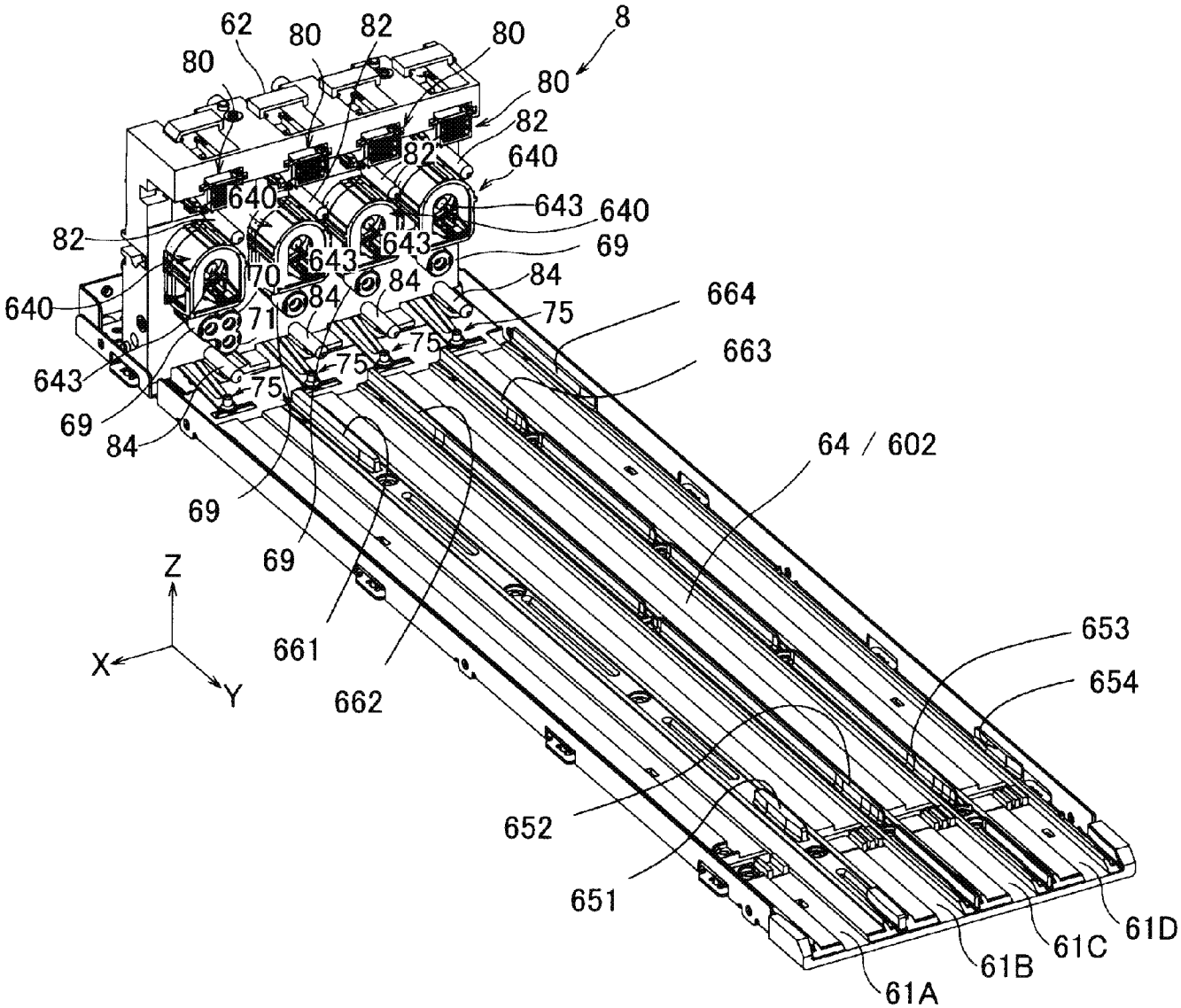
FIG. 3 is a perspective view of the cartridge attachment portion 6 with a cover member removed.

The plate 602 has slots 61A to 61D for attaching the respective cartridges 4, as shown in FIG. 3. These slots 61A to 61D extend from the side of the attaching mechanism portion 8 up to the cartridge attaching port 68, and guides the cartridges 4 that is being attached from the side of the cartridge attaching port 68 to the side of the attaching mechanism portion 8.

The attaching mechanism portion 8 includes an air injection port 69, an attaching engagement ratchet 75, a contact mechanism 80, a first attachment bar 82, a second attachment bar 84, a flow unit 640, and an ink introduction tube 643 for each of the slots 61A to 61D. A first air sub-injection port 70 and a second air sub-injection port 71 are provided only for the slot 61A. Upon a later-described air injection tube 957 of the corresponding cartridge 4 being inserted into the air injection port 69, the air injection port 69 injects and absorbs the air into/from the cartridge 4 through this air injection tube 957. The attaching engagement ratchet 75 engages with the corresponding cartridge 4 at the last stage of attachment of the cartridge 4, and prevents the cartridge 4 in a completely attached state from being unintendedly withdrawn. The contact mechanism 80 includes a contact terminal group, comes into contact with a contact mechanism 50 (see FIG. 7) on the side of the cartridge 4, and transmits various kinds of data, such as the ink color and the amount of remaining ink, to the printer 10.

The first attachment bar 82 and the second attachment bar 84 engage with the corresponding cartridge 4 at the last stage of attachment of the cartridge 4, and position the cartridge 4 in a completely attached state. The flow unit 640 is configured to surround the ink introduction tube 643 (liquid introduction tube) for achieving introduction of ink to the printer 10, and assists insertion of the ink introduction tube 643 into a later-described ink supply port 414 (liquid supply port) of the cartridge 4 while receiving force applied from the cartridge 4 at the last stage of attachment of the cartridge 4. A later-described first air sub-injection tube 958 and second air sub-injection tube 959 of the cartridge 4 are inserted respectively into the first air sub-injection port 70 and the second air sub-injection port 71 at the last stage of attachment of the cartridge 4. The first air sub-injection port 70 and the second air sub-injection port 71 inject and absorb the air into/from two air injection bags (not shown) in the cartridge through the respective sub-injection tubes. Note that the air injection port 69, the first air sub-injection port 70, and the second air sub-injection port 71 inject and absorb the air using an air pump (not shown) provided in the printer 10.

Figure 4:
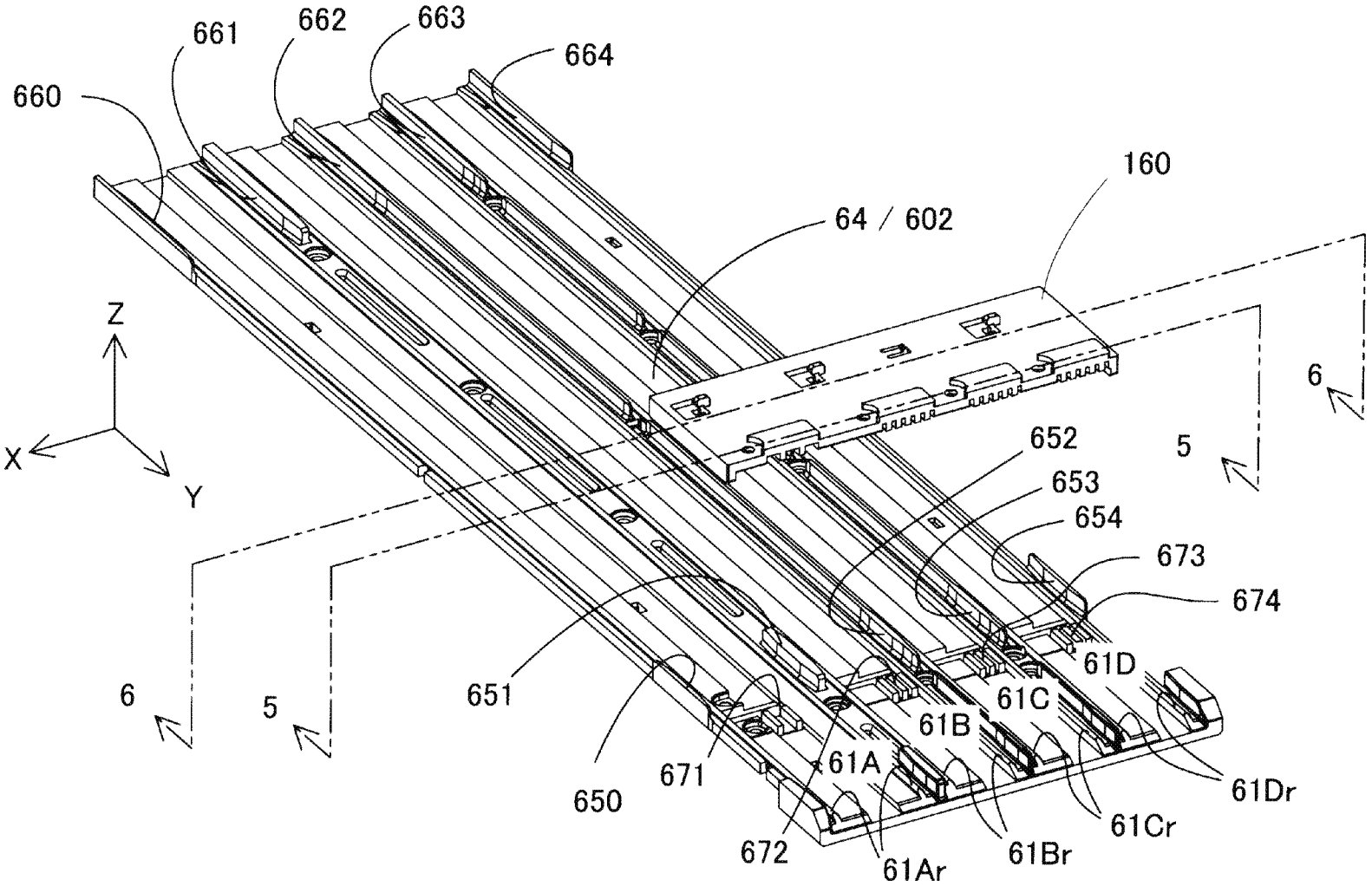
FIG. 4 is a perspective view schematically showing a relationship between a plate 602 and a misinsertion prevention plate 160.
Figure 5:
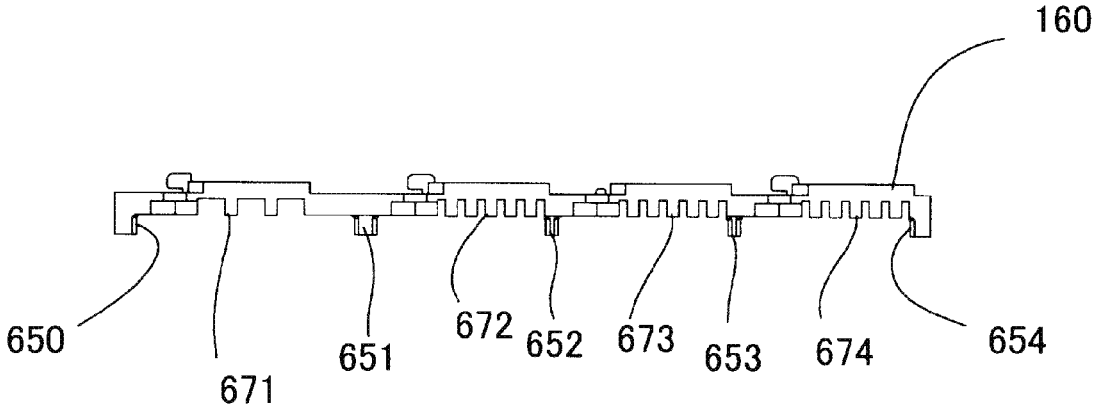
FIG. 5 is an illustrative diagram showing a relationship between the plate 602 and the misinsertion prevention plate 160 as viewed in a cross-section taken along line 5-5 in FIG. 4.
Figure 5:
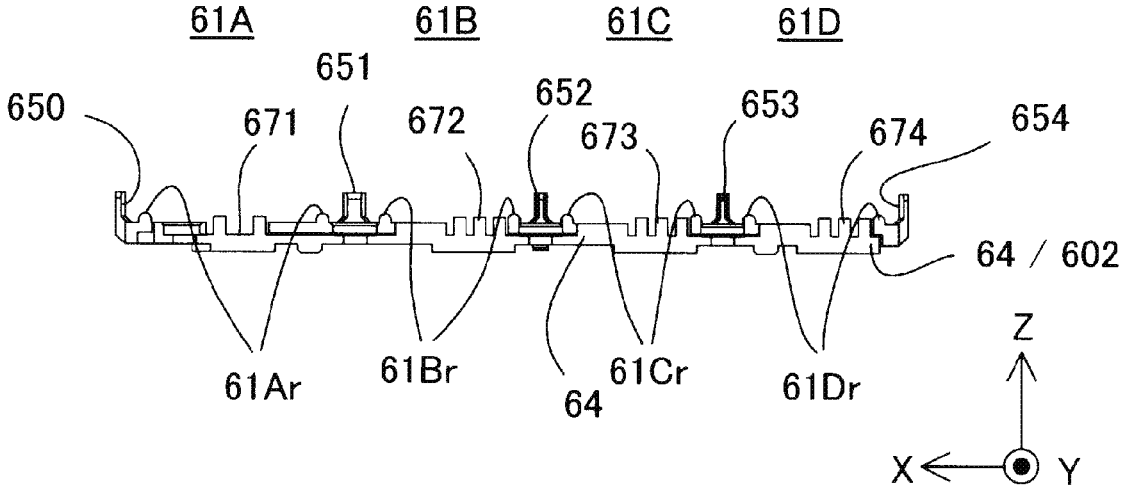
Figure 6:
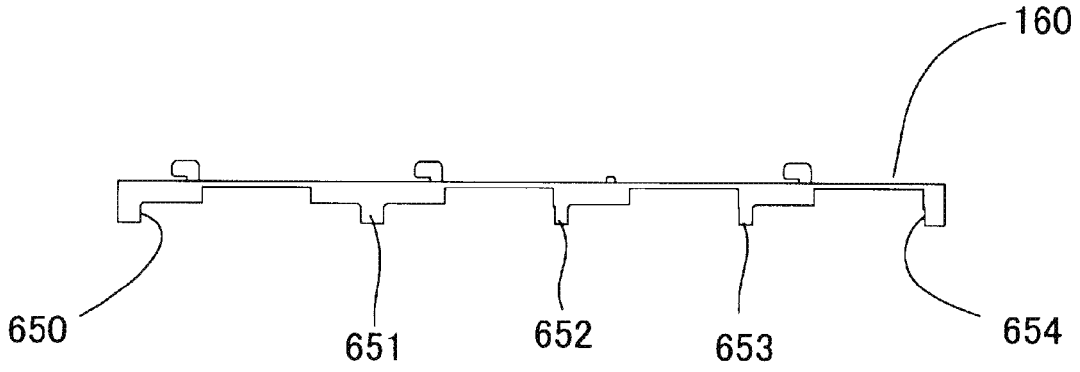
FIG. 6 is an illustrative diagram showing a relationship between the plate 602 and the misinsertion prevention plate 160 as viewed in a cross-section taken along line 6-6 in FIG. 4.
Figure 6:
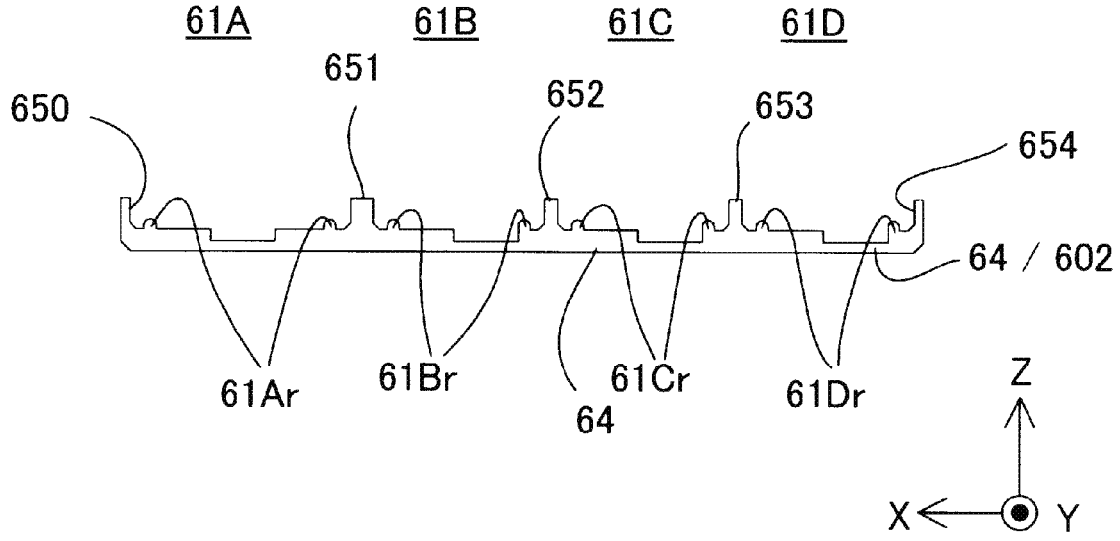

Next, a description will be given of a configuration of the plate 602 and the misinsertion prevention plate 160 including integration of the misinsertion prevention plate 160. FIG. 4 is a perspective view schematically showing a relationship between the plate 602 and the misinsertion prevention plate 160. FIG. 5 is an illustrative diagram showing a relationship between the plate 602 and the misinsertion prevention plate 160 as viewed in a cross-section taken along line 5-5 in FIG. 4. FIG. 6 is an illustrative diagram showing a relationship between the plate 602 and the misinsertion prevention plate 160 as viewed in a cross-section taken along line 6-6 in FIG. 4.

As shown in the drawings, the plate 602 includes cartridge lower face rails 61Ar to 61Dr, first guide rails 650 to 654, second guide rails 660 to 664, and misinsertion prevention portions 671 to 674 for the respective slots 61A to 61D. The cartridge lower face rails 61Ar to 61Dr are each formed as a pair of projections extending in the Y-axis direction (insertion direction) in the corresponding slot, and receive a later-described third wall 44 (see FIG. 8) that serves as a lower face of the corresponding cartridge 4.

The first guide rails 650 to 654 of the plate 602 are located at positions opposed to the misinsertion prevention plate 160, i.e., on the proximal, front side of the cartridge attachment portion 6, face the first guide rail with the corresponding cartridge lower face rails 61Ar to 61Dr therebetween, and guide the cartridges 4 at the initial stage of cartridge attachment. The second guide rails 660 to 664 are located distant from the first guide rails 650 to 654 on the distal, rear side of the cartridge attachment portion 6, face one another with the cartridge lower face rails 61Ar to 61Dr therebetween, and guide the cartridges 4 at the last stage of cartridge attachment. The guiding using the guide rails will be described later.

The misinsertion prevention portions 671 to 674 of the plate 602 are located at positions opposed to the misinsertion prevention plate 160 on the proximal, front side of cartridge attachment portion 6, project vertically upward between the cartridge lower face rails 61Ar to 61Dr, and prevent misinsertion of the cartridges 4 on the attachment proximal, front side by interfering with a later-described misinsertion prevention lower face projection portion 141 in the third walls 44 of the cartridges 4. In the printer 10 according to this embodiment, the cartridge 4 for containing black ink is the cartridge 4A having a large capacity, and the cartridges 4 for the other colors are the cartridges 4B to 4D having a small capacity. The misinsertion prevention lower face projection portions 141 of the cartridges 4 have different shapes between the cartridge 4A and the cartridges 4B to 4D. Accordingly, only when the cartridges 4 of correct colors are inserted, the misinsertion prevention portions 671 to 674 of the plate 602 do not interfere with the misinsertion prevention lower face projection portion 141 in the third wall 44 of the inserted cartridges 4 and allow the cartridge attachment. On the other hand, if cartridges 4 of incorrect colors are misinserted, the misinsertion prevention portions 671 to 674 interfere with the misinsertion prevention lower face projection portions 141 in the third walls 44 of the misinserted cartridges 4 to prevent misinsertion of the cartridges 4 on the attachment proximal, front side.

The positional relationship between the misinsertion prevention plate 160 and the plate 602 (opposed positional relationship) is maintained by the cover member 604 (see FIG. 2). As shown in FIGS. 5 and 6, the misinsertion prevention plate 160 has first guide rails 650 to 654 and misinsertion prevention portions 671 to 674 as the plate 602 does. The first guide rails 650 to 654 of the misinsertion prevention plate 160 guide the cartridges 4 on the side of second walls 43 (see FIG. 7) thereof at the initial stage of cartridge attachment. The misinsertion prevention portions 671 to 674 of the misinsertion prevention plate 160 project vertically downward, are arranged so as to be opposed respectively to the misinsertion prevention portions 671 to 674 of the plate 602, and prevent misinsertion of the cartridges 4 on the attachment proximal, front side by interfering with a later-described misinsertion prevention upper wall projection portion 140 in the second walls 43 of the cartridges 4. The prevention of misinsertion is as already described above. The misinsertion prevention portions 671 to 674 of the misinsertion prevention plate 160 do not interfere with the misinsertion prevention upper face projection portion 140 only when the cartridges 4 of correct colors are inserted. If the cartridges 4 of incorrect colors are misinserted, the misinsertion prevention portions 671 to 674 interfere with the misinsertion prevention upper face projection portions 140 of the misinserted cartridges 4 and prevent misinsertion of the cartridges 4. The prevention of erroneous operations using the misinsertion prevention portions 671 to 674 will be described later when describing the misinsertion prevention upper face projection portions 140 and the misinsertion prevention lower face projection portions 141 of the cartridges 4.

A-3: Appearance Configuration of Cartridge

Figure 7:
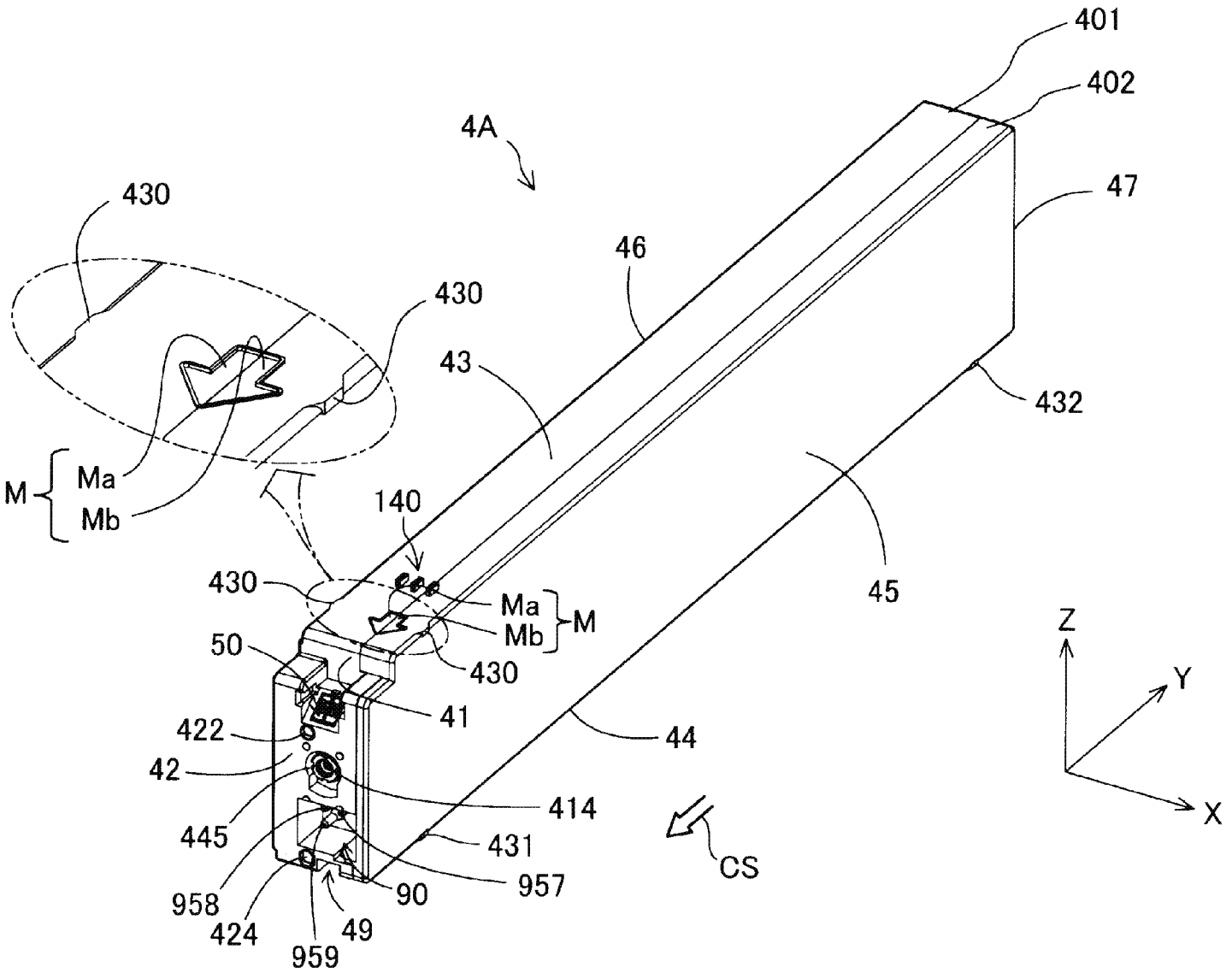
FIG. 7 is a perspective view of an appearance of a cartridge 4A.
Figure 8:
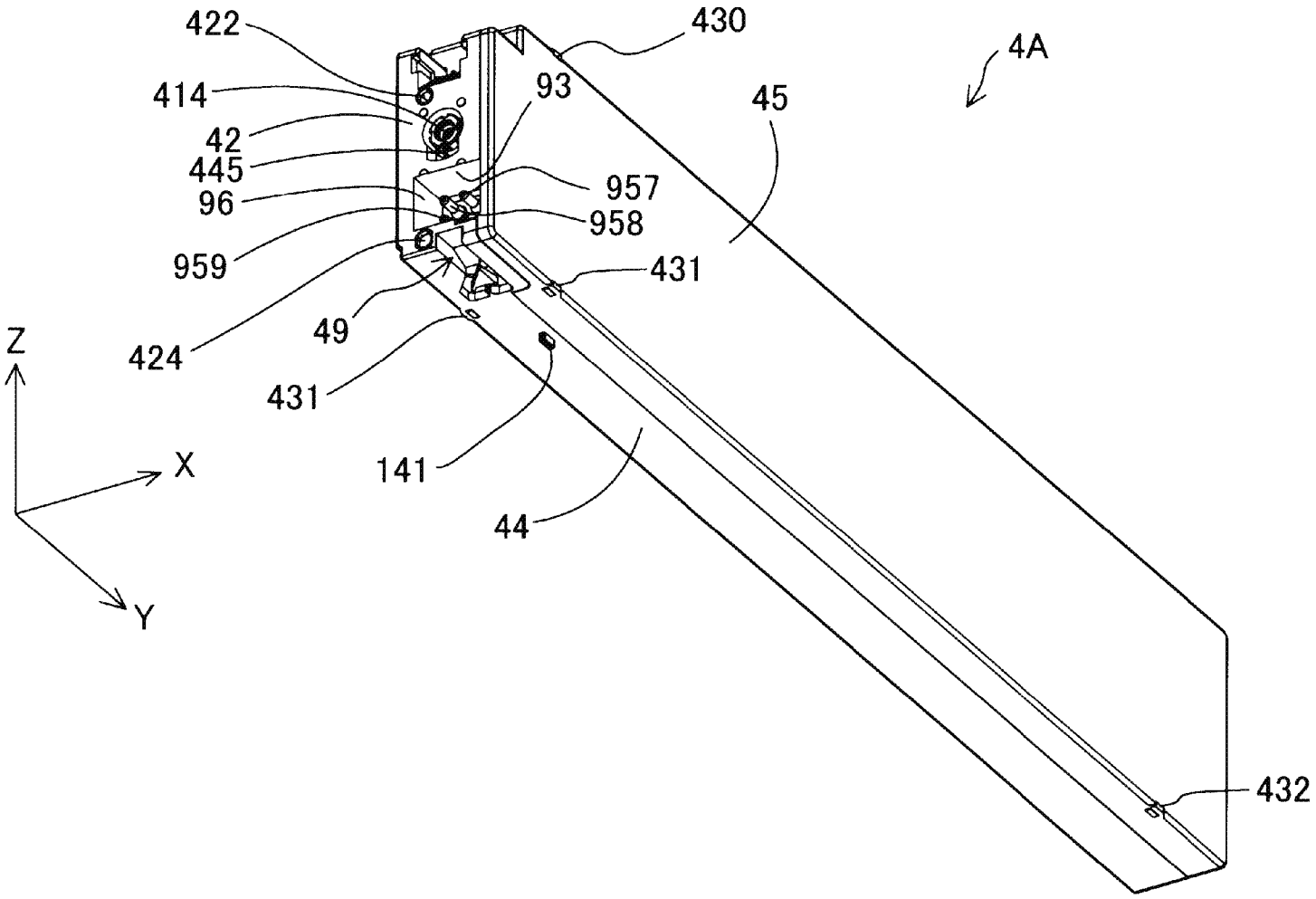
FIG. 8 is a diagram illustrating the cartridge 4A as viewed obliquely from the lower face side.
Figure 9:
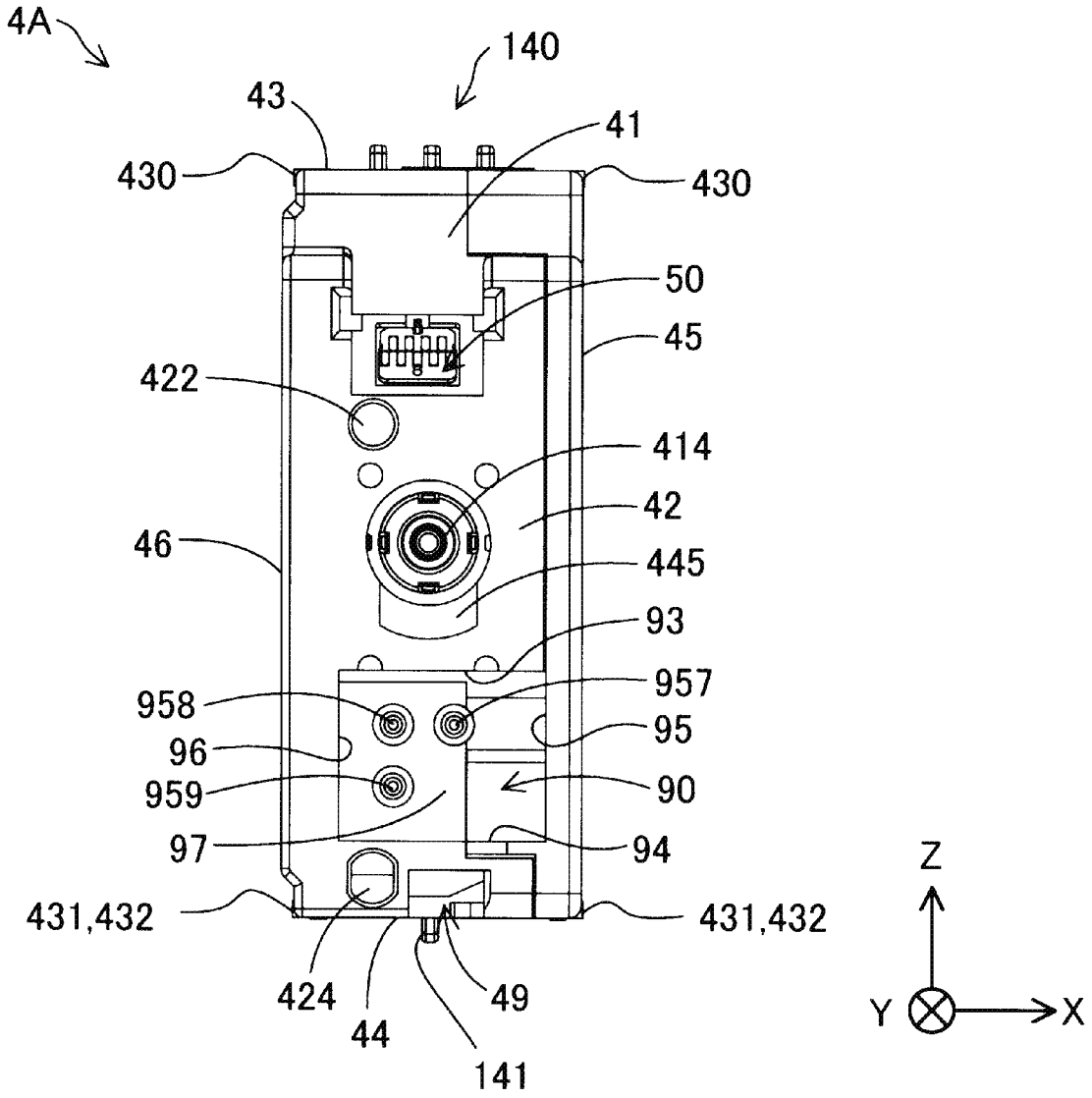
FIG. 9 is a diagram illustrating the side of an attachment end of the cartridge 4A as viewed from the front.

Next, a detailed configuration of the cartridges 4 will be described. In the printer 10 according to this embodiment, the cartridges 4 are separately used for the respective ink colors. Black ink, which is frequently used, is contained in the cartridge 4A having a large capacity, and ink of the other colors is contained in the cartridges 4B to 4D having a smaller capacity than that of the cartridge 4A. A detailed configuration of the cartridges will be described below, taking the cartridge 4A as an example. FIG. 7 is a perspective view showing an appearance of the cartridge 4A. FIG. 8 is an illustrative diagram showing the cartridge 4A as viewed obliquely from the lower face side. FIG. 9 is an illustrative diagram showing the side of the attachment end of the cartridge 4A as viewed from the front.

As shown in FIG. 7, the cartridge 4A has an elongated shape extending in the attaching direction, i.e., the Y-axis direction from the attachment end thereof to be attached to the cartridge attachment portion 6 of the printer 10. The cartridge 4A is configured by combining a second case 402 with a first case 401. The first case 401 forms an elongated shape extending in the attaching direction CS, one end face thereof is open along the longitudinal direction, and the inside of the opening serves as an ink containing portion (not shown). The second case 402 also forms an elongated shape extending in the attaching direction CS, and is combined with the first case 401 so as to cover the opening of the first case 401. The ink containing portion (not shown) within the opening is thereby sealed. The cartridge 4A has a first wall 42 serving as an attachment end, which is one end thereof when both cases are combined with each other, and surrounds the ink containing portion (not shown) with the first wall 42 located in the forward direction of the attaching direction CS, a second wall 43 extending in a cartridge upper face toward the other end, a third wall 44 extending in a cartridge lower face toward the other end, a fourth wall 45 that is an elongated face of the second case 402, a fifth wall 46 that is an elongated face of the first case 401, and a sixth wall 47 on the other end.

An upper corner portion of the first wall 42 is a recessed portion 41, and the first wall 42 of the cartridge 4A includes, from the side of the recessed portion 41, the contact mechanism 50, a first bar insertion hole 422, the ink supply port 414, a first bottomed recessed portion 445, a second bottomed recessed portion 90, a second bar insertion hole 424, and a ratchet engaging portion 49. The contact mechanism 50 includes a contact terminal group, comes into contact with the contact mechanism 80 (see FIG. 3) in the attaching mechanism portion 8 of the cartridge attachment portion 6, and transmits various kinds of data, such as the ink color and the amount of remaining ink, to the printer 10. The first attachment bar 82 and the second attachment bar 84 of the attaching mechanism portion 8 enter the first bar insertion hole 422 and the second bar insertion hole 424 at the last stage of attachment of the cartridge 4A, and the first bar insertion hole 422 and the second bar insertion hole 424 position the cartridge 4A in a completely attached state. The ink supply port 414 opens forward in the attaching direction CS. The ink introduction tube 643 of the attaching mechanism portion 8 is inserted into the ink supply port 414 at the last stage of attachment of the cartridge 4A, and the ink supply port 414 supplies ink through suction by a pump (not shown) from the side of the cartridge attachment portion 6.

The first bottomed recessed portion 445 is formed so as to surround the ink supply port 414, and receives the flow unit 640 (see FIG. 3) of the cartridge attachment portion 6 at the last stage of attachment of the cartridge 4A. As shown in FIG. 8, the second bottomed recessed portion 90 is formed by a first recessed portion wall 93, a second recessed portion wall 94, a third recessed portion wall 95, and a fourth recessed portion wall 96 so as to have a bottom, and surrounds the air injection tube 957, the first air sub-injection tube 958, and the second air sub-injection tube 959. The air injection tube 957 enters the air injection port 69 of the attaching mechanism portion 8 at the last stage of the cartridge 4A, and is for injecting and absorbing the air into/from the inside space of the cartridge 4. The first air sub-injection tube 958 and the second air sub-injection tube 959 respectively enter the first air sub-injection port 70 and the second air sub-injection port 71 of the attaching mechanism portion 8 at the last stage of attachment of the cartridge 4A, and inject and absorb the air into/from the two air injection bags (not shown) in the cartridge. Note that the air is injected absorbed through the air injection tube 957, the first air sub-injection tube 958, and the second air sub-injection tube 959 using an air pump (not shown) provided in the printer 10. The ratchet engaging portion 49 is formed in the cartridge lower face located on the side of the first wall 42. The attaching engagement ratchet 75 of the attaching mechanism portion 8 engages with the ratchet engaging portion 49 at the last stage of attachment of the cartridge 4A, and the ratchet engaging portion 49 prevents the cartridge 4 in a completely attached state from being unintendedly withdrawn.

The cartridge 4A also has an arrow mark M indicating the attaching direction CS in upper faces of the first case 401 of the second case 402, i.e., the vertically upper faces when the cartridge 4A is in a state of being attached to the printer 10. This arrow mark M is formed such that the outline of the arrow rises in a projecting manner, and molded on the side of the ink supply port 414 (liquid supply port) relative to the center of the cartridge 4A in the longitudinal direction. In this embodiment, the arrow mark M is molded on the side of the attachment end, which is the side of the first wall 42 of the cartridge 4A. The arrow mark M is divided into a half arrow mark Ma on the side of the first case 401 and a half arrow mark Mb on the side of the second case 402. A single mark (arrow mark) is formed when the first case 401 and the second case 402 are combined with each other and allows a user to recognize that the direction indicted by the arrow is the attaching direction CS of the cartridge 4A.

In addition, the cartridge 4A includes, from the side of the first wall 42, restriction front upper face projection portions 430, restriction front lower face projection portions 431, the misinsertion prevention upper face projection portion 140, a misinsertion prevention lower face projection portion 141, and restriction rear projection portions 432, as shown in FIGS. 7 and 8. When the cartridge 4A for the black ink is attached to a correct attachment portion (slot 61A) in the cartridge attachment portion 6 of the printer 10, the misinsertion prevention upper face projection portion 140 and the misinsertion prevention lower face projection portion 141 do not interfere with the misinsertion prevention portions 671 (see FIG. 5) of the plate 602 and the misinsertion prevention plate 160 and allow cassette attachment. On the other hand, if any of the other cartridges 4B to 4D is attached to the slot 61A, the misinsertion prevention upper face projection portion 140 and the misinsertion prevention lower face projection portion 141 of the cartridge interfere with the misinsertion prevention portions 671 of the slot 61A and prevents misinsertion of the cartridges 4B to 4D in cooperation with the misinsertion prevention portions 671. Also, if the cartridge 4A is not attached to the correct attachment portion, or more specifically, if the cartridge 4A is attached to any of the slots 61B to 61D, the misinsertion prevention upper face projection portion 140 and the misinsertion prevention lower face projection portion 141 of the cartridge 4A interfere with the misinsertion prevention portions 672 of any of the slots 61B to 61D and prevent misinsertion of the cartridge 4A in cooperation with the misinsertion prevention portions 672. These misinsertion prevention upper face projection portion 140 and misinsertion prevention lower face projection portion 141 are each formed by a combination of projections formed in the upper face on the vertically upper side and the lower face that are located on the leading end side of the cartridge 4A in the attaching direction, i.e., on the side of the first wall 42, as shown in FIGS. 7 and 8.

As shown in FIG. 7, the misinsertion prevention upper face projection portion 140 of the cartridge 4A are constituted by three projections being arranged in the X-axis direction. Accordingly, the misinsertion prevention portions 671 (see FIG. 5) of the slot 61A in the misinsertion prevention plate 160 are molded so as not to interfere with the misinsertion prevention upper face projection portion 140 constituted by these three projections, and interfere with the misinsertion prevention upper face projection portions 140 of the other cartridges 4B to 4D. That is to say, the misinsertion prevention upper face projection portions 140 of the cartridges 4B to 4D are molded so as to interfere with any of the projections constituting the misinsertion prevention portions 671 of the slot 61A in the misinsertion prevention plate 160. On the other hand, the misinsertion prevention upper face projection portion 140 of the cartridge 4A is molded so as to interfere with each of the misinsertion prevention portions 672 to 674 of the slots 61B to 61D in the misinsertion prevention plate 160. The misinsertion prevention upper face projection portions 140 of the cartridges 4B to 4D will be described later.

As shown in FIG. 8, the misinsertion prevention lower face projection portion 141 provided in the vertically lower face of the cartridge 4A is constituted by a single projection. Accordingly, the misinsertion preventions portion 671 (see FIG. 5) of the slot 61A in the plate 602 are molded so as not to interfere with this misinsertion prevention lower face projection portion 141 constituted by the single projection, and interfere with the misinsertion prevention lower face projection portions 141 of the other cartridges 4B to 4D. That is to say, the misinsertion prevention lower face projection portions 141 of the cartridges 4B to 4D are molded so as to interfere with any of the projections constituting the misinsertion prevention portions 671 of the slot 61A in the plate 602. On the other hand, the misinsertion prevention lower face projection portion 141 of the cartridge 4A is molded so as to interfere with each of the misinsertion prevention portions 672 to 674 of the slots 61B to 61D in the plate 602. The misinsertion prevention lower face projection portions 141 of the cartridges 4B to 4D will be described later.

In order to cause such interference and non-interference, the number of projections constituting the misinsertion prevention upper face projection portion 140 in the vertically upper face is changed, or the projection height in the Z-axis direction, the projection width in the X-axis direction, or the interval is changed in the cartridges 4A to 4D, and then the shape of the misinsertion prevention portions 671 to 674 in the plate 602 and the misinsertion prevention plate 160 may be changed in accordance with such change. The same applies to the misinsertion prevention lower face projection portion 141 in the vertically lower face.

The restriction front face projection portions 430 in the vertically upper face and the restriction front lower face projection portion 431 in the vertically lower face are formed in a projecting shape in both side faces (the fourth wall 45 and the fifth face 46) that are parallel with the attaching direction of the cartridge 4A and different from the face in which the misinsertion prevention upper face projection portion 140 is provided, and are located on the leading end side in the attaching direction CS. These restriction front upper face projection portions 430 are formed on the side of the second wall 43 at a corner portion between the fourth wall 45 and the second wall 43 and a corner portion between the fifth wall 46 and the second wall 43. The restriction front lower face projection portions 431 are formed on the side of the third wall 44 at a corner portion between the fourth wall 45 and the third wall 44 and a corner portion between the fifth wall 46 and the third wall 44. The aforementioned restriction front upper face projection portions 430 and the restriction front lower face projection portions 431 on the leading end side in the attaching direction CS are arranged respectively between the first wall 42 on the leading end side in the attaching direction CS and the misinsertion prevention upper face projection portion 140 and between the first wall 42 and the misinsertion prevention lower face projection portion 141, and are arranged at positions closer to the aforementioned respective misinsertion prevention projection portions than to the ink supply port 414. The cartridge 4A also has the restriction rear projection portions 432 formed in a projecting shape on the trailing end side in the attaching direction, i.e., on the side of the sixth wall 47, and these restriction rear projection portions 432 are formed on the side of the third wall 44 at a corner portion between the fourth wall 45 and the third wall 44 and a corner portion between the fifth wall 46 and the third wall 44.

The thus-formed restriction front lower face projection portions 431 abut against the first guide rail 650 (see FIGS. 4 and 5) and the first guide rail 651 on the attachment proximal, front side that are opposed to each other with the cartridge lower face rail 61Ar of the slot 61A in the plate 602 therebetween. Thereby, the restriction front lower face projection portions 431 restrict a tilt of the cartridge 4A in an intersecting direction that intersects the attaching direction, on the side of the cartridge lower face at the initial stage of attachment. The restriction front face projection portions 430 abuts against the first guide rail 650 (see FIGS. 4 and 5) and the first guide rail 651 in the misinsertion prevention plate 160. Thereby, the restriction front upper face projection portions 430 restrict a tilt of the cartridge 4A in an intersecting direction that intersects the attaching direction, on the side of the cartridge upper face at the initial stage of attachment.

At the last stage of attachment of the cartridge 4A, the restriction front lower face projection portions 431 abut against the second guide rail 660 (see FIGS. 3 and 4) and the second guide rail 661 on the attachment distal, rear side that are opposed to each other with the cartridge lower face rail 61Ar of the slot 61A in the plate 602 therebetween. Thereby, the restriction front lower face projection portions 431 restrict a tilt of the cartridge 4A, on the side of the cartridge lower face at the last stage of attachment. The restriction rear projection portions 432 (rear restriction portions) in the lower face on the trailing end side in the attaching direction abut against the first guide rail 650 (see FIGS. 4 and 5) and the first guide rail 651 on the attachment proximal, front side that are opposed to each other with the cartridge lower face rail 61Ar of the slot 61A in the plate 602 therebetween, and restrict a tilt of the cartridge 4A in an intersecting direction that intersects the attaching direction, on the side of the cartridge lower face at the last stage of attachment. That is to say, at the last stage of attachment, the restriction front lower face projection portions 431 that abut against the second guide rail 660 and the second guide rail 661 on the attachment distal, rear side and the restriction rear projection portions 432 that abut against the first guide rail 650 and the first guide rail 651 on the attachment proximal, front side cooperate with one another to restrict a tilt of the cartridge 4A in an intersecting direction that intersects the attaching direction CS.

Figure 10:
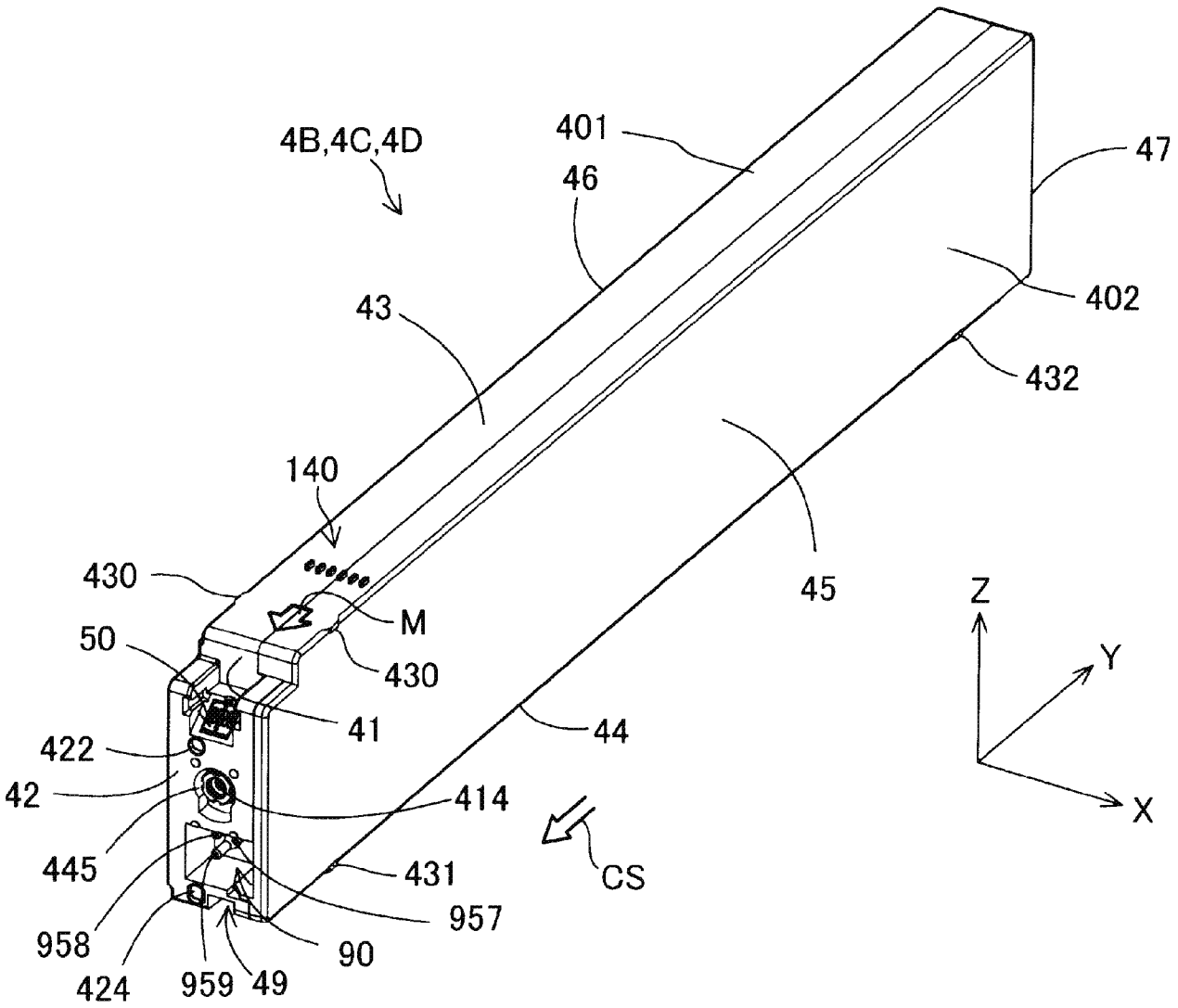
FIG. 10 is a perspective view of an appearance of cartridges 4B to 4D.
Figure 11:
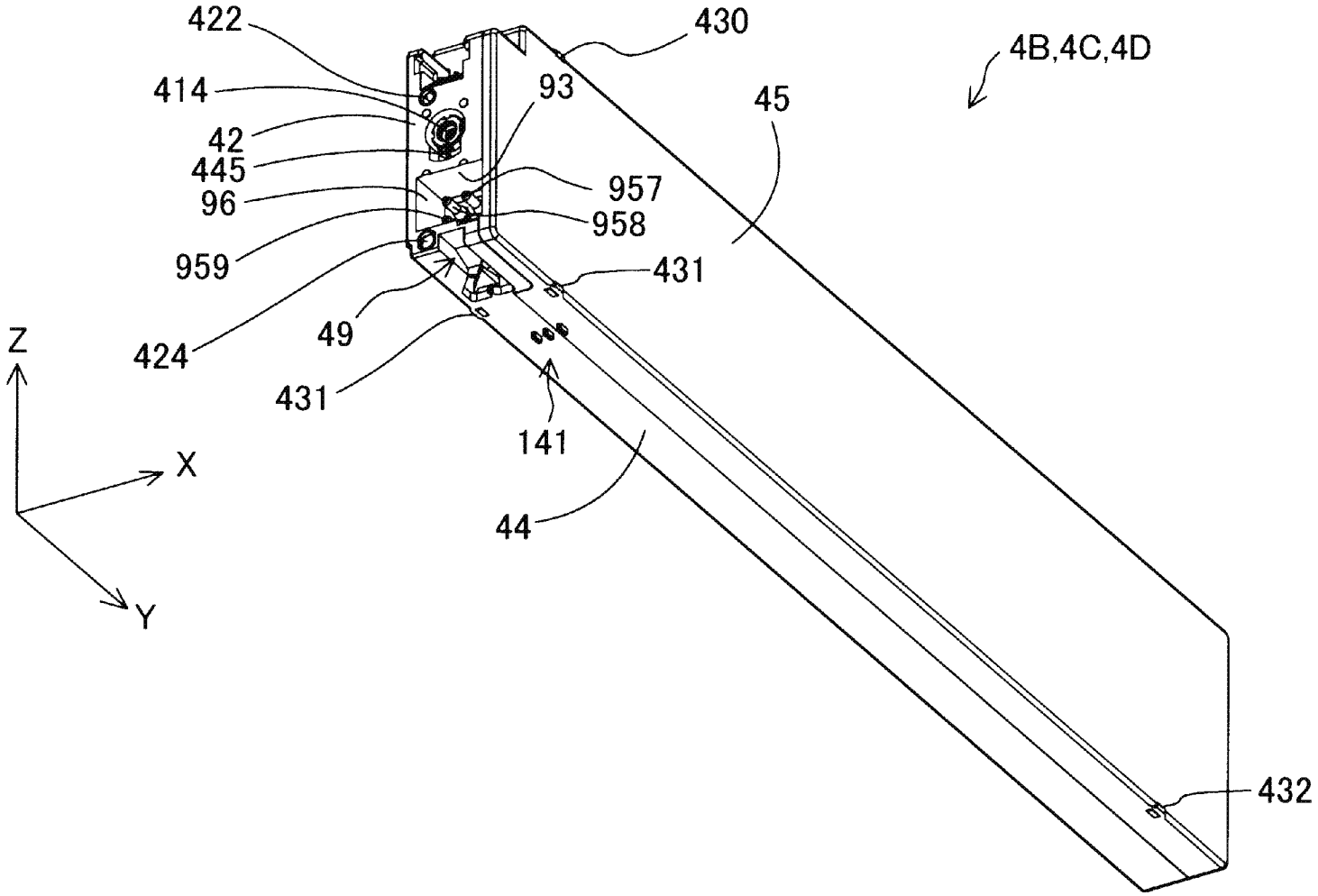
FIG. 11 is an illustrative diagram showing the cartridges 4B to 4D as viewed obliquely from the lower face side.

FIG. 10 is a perspective view of an appearance of the cartridges 4B to 4D, and FIG. 11 is an illustrative diagram showing the cartridges 4B to 4D as viewed obliquely from the lower face side. The cartridges 4B to 4D each also form an elongated shape, are each formed by combining the second case 402 with the first case 401, and each have the already-described arrow mark M provided in a divided manner in the upper face of these cases, similarly to the already-described cartridge 4A. Since the cartridges 4B to 4D contain the ink of the colors other than black, namely cyan, magenta, and yellow as mentioned above, the thickness of the first case 401 thereof in the X-axis direction are made smaller than that of the cartridge 4A so as to have a smaller internal volume. Other configurations, such as a configuration in which the restriction front upper face projection portions 430, the restriction front lower face projection portions 431, the restriction rear projection portions 432, the misinsertion prevention upper face projection portion 140 and the misinsertion prevention lower face projection portion 141 in the vertically upper and lower faces, and the like are provided, are the same as in the cartridge 4A.

The misinsertion prevention upper face projection portions 140 of the cartridges 4B to 4D each have a shape that is different from the misinsertion prevention upper face projection portion 140 of the cartridge 4A or the other cartridges in accordance with the color of the ink to be contained, and prevent misinsertion by engaging with the misinsertion prevention portions 672 to 674 of the plate 602 and the misinsertion prevention plate 160 of the cartridge attachment portion 6. In the drawing, the number of projections of the misinsertion prevention upper face projection portion 140 in the vertically upper face is larger than that of the misinsertion prevention upper face projection portions 140 of the cartridge 4A, and the projection width in the X-axis direction and the interval thereof are narrower. The misinsertion prevention upper face projection portions 140 of the cartridges 4B to 4D are different from that of the cartridge 4A in this regard. In addition, in the cartridges 4B to 4D, a difference can be made among the cartridges by changing the number of projections constituting the misinsertion prevention upper face projection portion 140 or the arrangement positions thereof. The misinsertion prevention lower face projection portion 141 in the vertically lower face are formed as smaller projections than the misinsertion prevention lower face projection portion 141 of the cartridge 4A so as to conform to the misinsertion prevention portions 672 to 674 of the plate 602 in the slots 61B to 61D shown in FIG. 5, and then the number of the projections of the misinsertion prevention lower face projection portions 141 of the cartridges 4B to 4D is changed. Thus, the misinsertion prevention lower face projection portions 141 of the cartridges 4B to 4D are different from those of the cartridge 4A. As for the difference among the cassettes of the cartridges 4B to 4D, the cassettes are also different from one another by setting, in the respective cassettes, different arrangement positions of the projections constituting the misinsertion prevention lower face projection portion 141.

Figure 12:
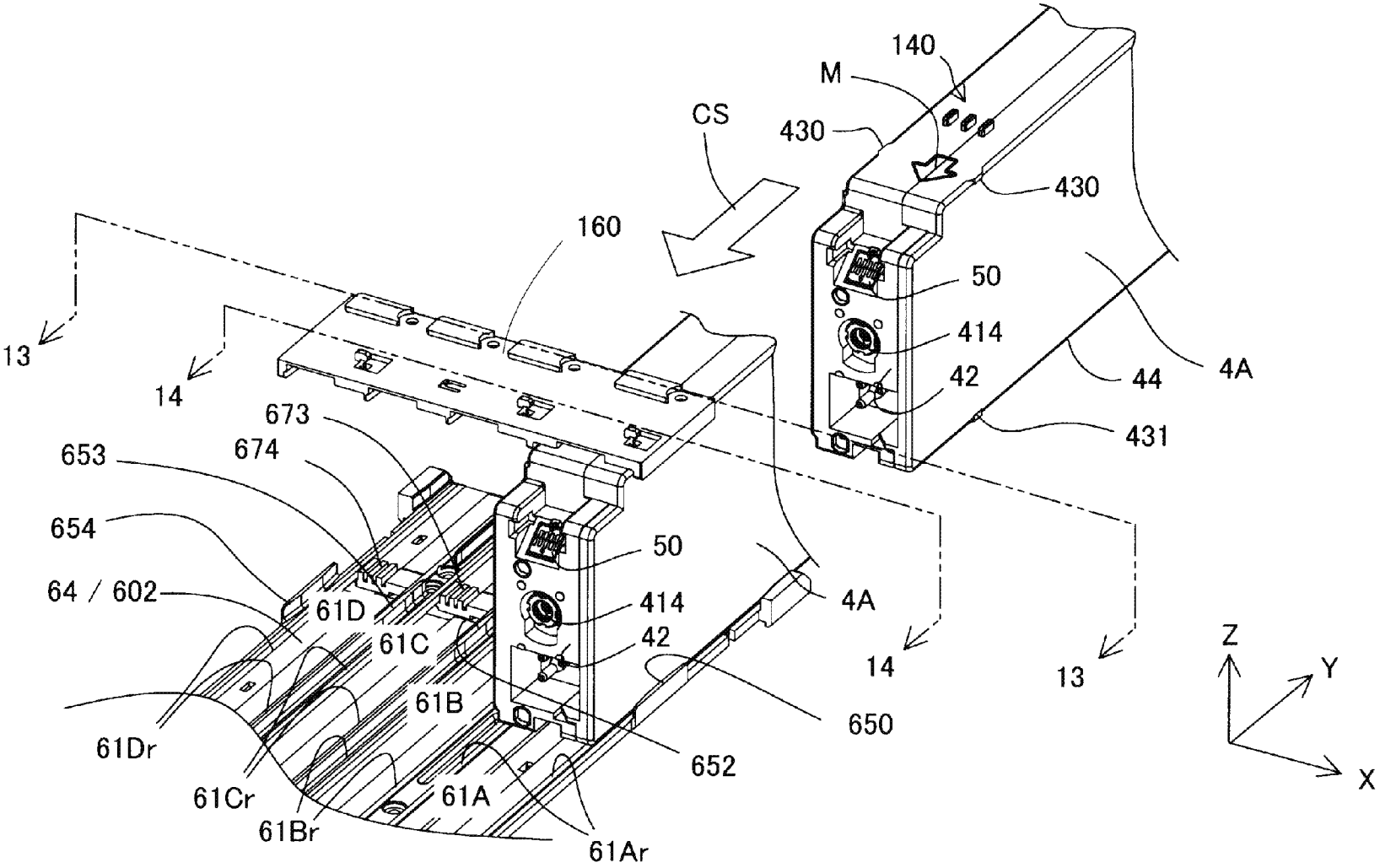
FIG. 12 is an illustrative diagram showing the initial stage of attachment of the cartridge 4A to the plate 602 that constitutes the cartridge attachment portion 6.
Figure 13:
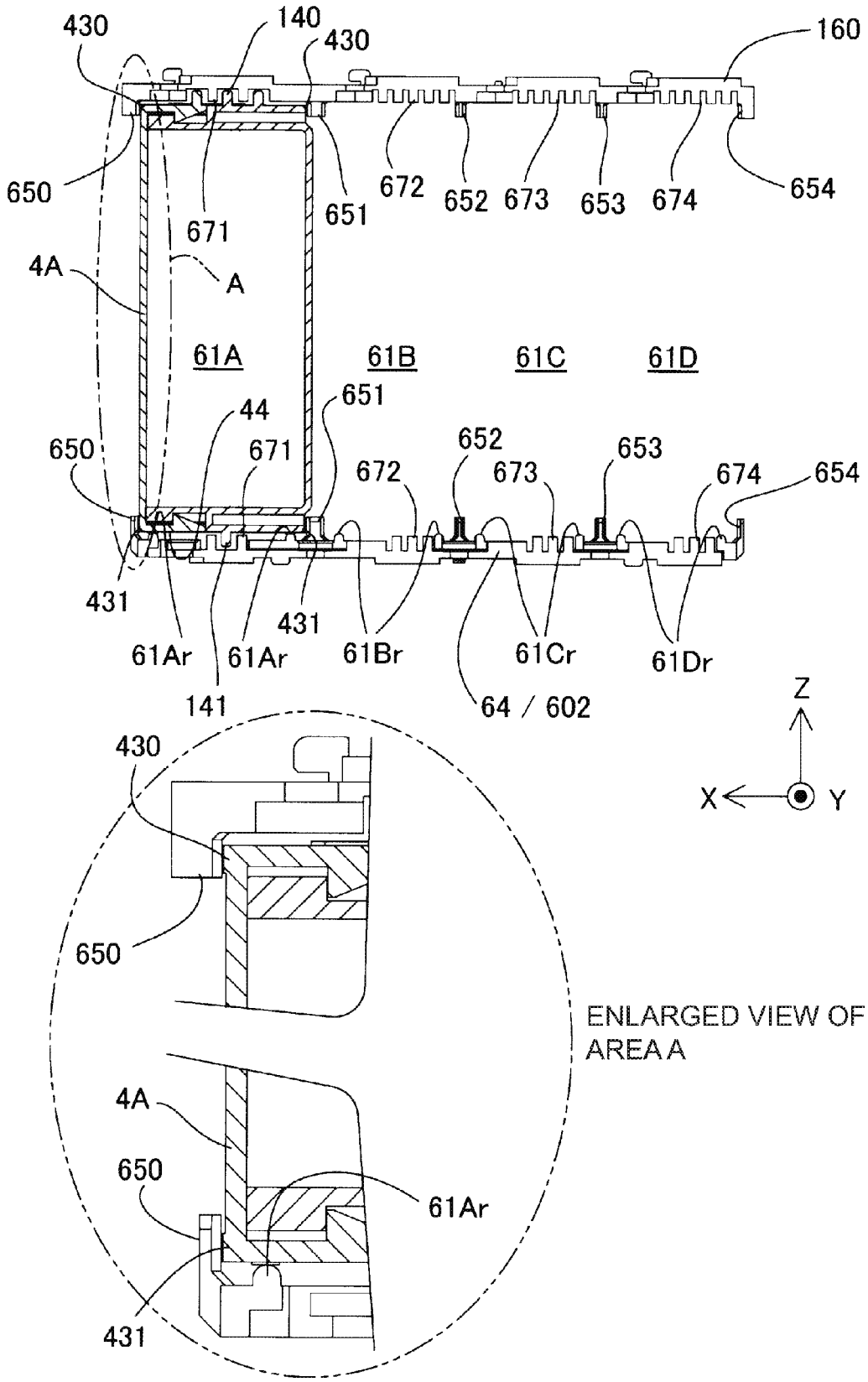
FIG. 13 is an illustrative diagram showing a relationship between the plate 602 and the misinsertion prevention plate 160 with respect to the cartridge 4A at the initial stage of attachment, as viewed in a cross-section taken along line 13-13 in FIG. 12.
Figure 14:
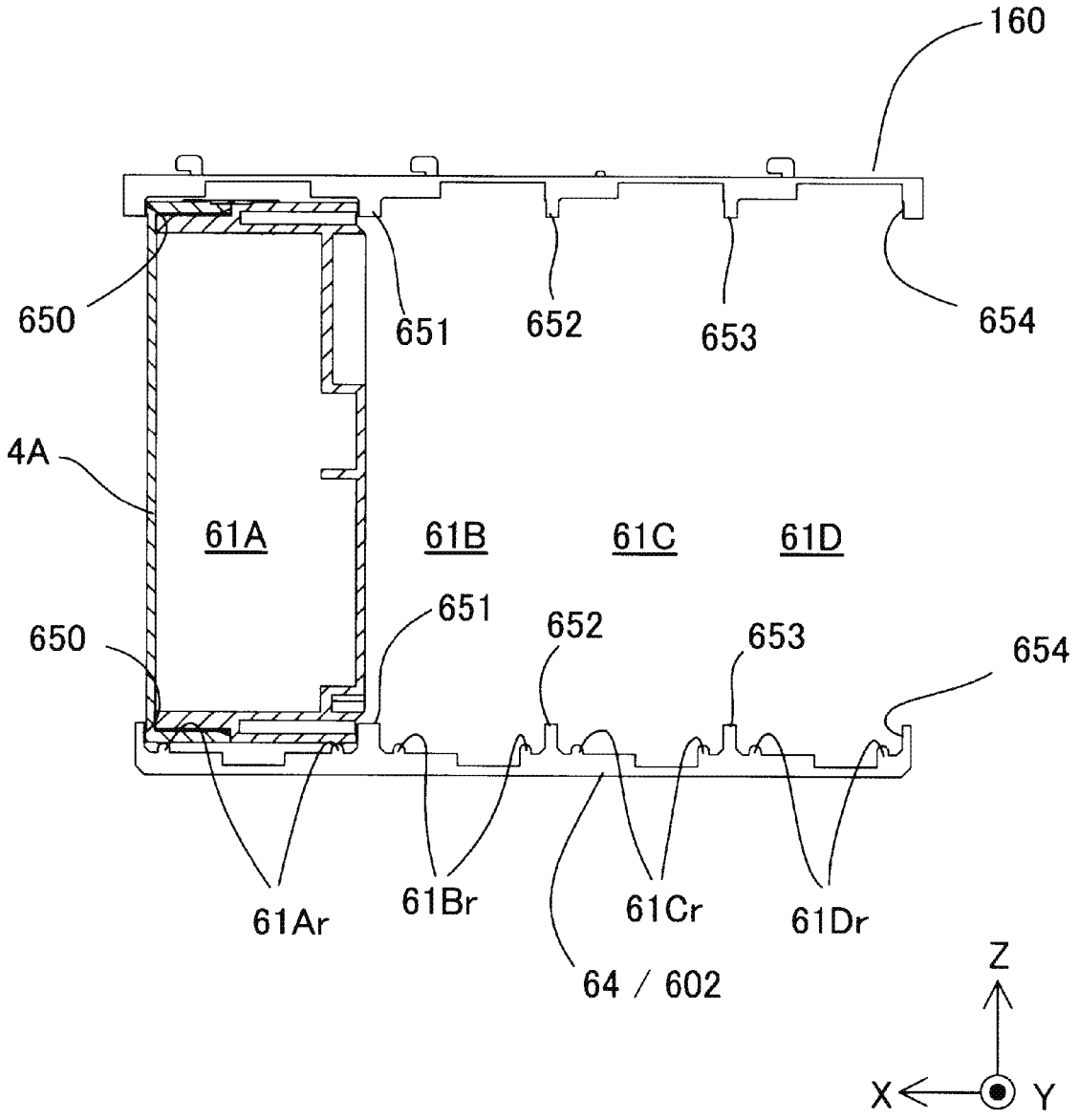
FIG. 14 is an illustrative diagram showing a relationship between the plate 602 and the misinsertion prevention plate 160 with respect to the cartridge 4A at the initial stage of attachment, as viewed in a cross-section taken along line 14-14 in FIG. 12.

Advantages achieved by the cartridges 4 having the above-described configuration according to this embodiment will now be described together with cartridge attachment, taking the cartridge 4A as an example. FIG. 12 is an illustrative diagram showing the initial stage of attachment of the cartridge 4A to the plate 602 constituting the cartridge attachment portion 6. FIG. 13 is an illustrative diagram showing a relationship between the plate 602 and the misinsertion prevention plate 160 with respect to the cartridge 4A at the initial stage of attachment, as viewed in a cross-section taken along line 13-13 in FIG. 12. FIG. 14 is an illustrative diagram showing a relationship between the plate 602 and the misinsertion prevention plate 160 with respect to the cartridge 4A at the initial stage of attachment, as viewed in a cross-section taken along line 14-14 in FIG. 12.

When attaching the cartridge 4A to the cartridge attachment portion 6 (see FIG. 2), the cartridge 4A is inserted into the cartridge attaching port 68 (see FIG. 2) of the cartridge attachment portion 6 from the attachment end on the side of the first wall 42. Since the attaching direction CS at this time is indicated by the arrow mark M, the user inserts the cartridge 4A into the cartridge attaching port 68 while looking at the arrow mark M. The thus-inserted cartridge 4A is supported at the third wall 44 serving as the cartridge lower face by the cartridge lower face rail 61Ar, as shown in FIG. 13. On the side of this cartridge lower face, only the restriction front lower face projection portions 431 are caused to abut against the first guide rail 650 and the first guide rail 651 on the proximal, front side of the plate 602 at the time of insertion. At this time, on the side of the cartridge upper face, only the restriction front upper face projection portions 430 are caused to abut against the first guide rail 650 and the first guide rail 651 on the attachment proximal, front side of the misinsertion prevention plate 160. Accordingly, with the cartridge 4A according to this embodiment, the portions with which the first guide rails 650 and the first guide rails 651 on the proximal, front side at the time of insertion abut are restricted to the restriction front upper face projection portions 430 and the restriction front lower face projection portions 431 that have a projecting shape, and it is thereby possible to appropriately set a gap with respect to the aforementioned guide rails and secure adequate slidability.

The cartridge 4A according to this embodiment restricts a tile of the cartridge 4A in an intersecting direction that intersects the attaching direction at the initial stage of cartridge attachment as a result of the restriction front upper face projection portions 430 and the restriction front lower face projection portions 431 abutting against the first guide rails 650 and the first guide rails 651 on the attachment proximal, front side. Thereby, the positional relationship is secured between the misinsertion prevention portions 671 of the plate 602 and of the misinsertion prevention plate 160 and the misinsertion prevention upper face projection portion 140 and misinsertion prevention lower face projection portion 141 on the cartridge side. As a result of this, the cartridge 4A according to this embodiment can be smoothly attached, increasing the attachability.

The cartridge 4A according to this embodiment achieves the abutting against the first guide rails using the restriction front upper face projection portions 430 on the cartridge upper face side and the restriction front lower face projection portions 431 on the cartridge lower face side. Therefore, the above-described positional relationship can be more reliably secured, further increasing the attachability. In addition, a tilt of the cartridge along the vertical direction is also suppressed as a result of the restriction projection portions abutting against the first guide rails on the cartridge upper and lower face sides, and it is thereby possible to reduce the risk of occurrence of liquid leakage and contact failure of the terminal.

The cartridge 4A according to this embodiment also causes the restriction front lower face projection portions 431 to abut against the second guide rail 660 and the second guide rail 661 on the attachment distal, rear side. For this reason, the accuracy with which the ink introduction tube 643 (see FIG. 3) of the flow unit 640 is opposed to the ink supply port 414 is improved. Accordingly, with the cartridge 4A according to this embodiment, the reliability in the insertion of the ink introduction tube 643 into the ink supply port 414 is improved.

The cartridge 4A according to this embodiment also causes the restriction rear projection portions 432 to abut against the first guide rail 650 and the first guide rail 651 on the attachment proximal, front side when the restriction front lower face projection portions 431 abut against the second guide rail 660 and the second guide rail 661 on the attachment distal, rear side. Thereby, at the last stage of attachment, a tile of the cartridge 4A in an intersecting direction that intersects the attaching direction CS can be restricted by the restriction front lower face projection portions 431 and the restriction rear projection portions 432 on the side of the attachment end. Therefore, the accuracy with which the ink introduction tube 643 is opposed to the ink supply port 414 is further improved, and the reliability in the insertion of the ink introduction tube 643 into the ink supply port 414 is also further improved.

In the cartridge 4A according to this embodiment, the misinsertion prevention upper face projection portion 140 and the misinsertion prevention lower face projection portion 141 in the cartridge upper and lower faces are arranged on the leading end side in the attaching direction. Accordingly, with the cartridge 4A according to this embodiment, erroneous attachment of the cartridge can be prevented before the ink introduction tube 643 of the cartridge attachment portion 6 in the printer 10 is inserted and connected to the ink supply port 414. Furthermore, with the cartridge 4A according to this embodiment, erroneous attachment is prevented at the time point when the leading end side of the cartridge reaches the misinsertion prevention plate 160, and it is accordingly possible to prompt, at an early stage, a user to attach the cassette to a correct attachment slot (the slot 61A in this case).

In the cartridge 4A according to this embodiment, the restriction front upper face projection portions 430 and the restriction front lower face projection portions 431 on the sides of the cassette upper and lower faces are arranged at positions closer to the misinsertion prevention upper face projection portion 140 and the misinsertion prevention lower face projection portion 141 than to the ink supply port 414. Accordingly, with the cartridge 4A according to this embodiment, even if the cartridge 4A that is being attached tilts, a shift of these misinsertion prevention projection portions caused by the tilt can be reduced as a result of the aforementioned restriction projection portions being arranged close to the misinsertion prevention projection portions. It is therefore possible to reduce the risk of erroneous interference of the misinsertion prevention upper face projection portion 140 and the misinsertion prevention lower face projection portion 141 with the misinsertion prevention portions 671 of the plate 602 and the misinsertion prevention plate 160 without engaging therewith. The accuracy of cartridge attachment is thereby improved.

In the cartridge 4A according to this embodiment, the restriction front upper face projection portions 430, the restriction front lower face projection portions 431, and the restriction rear projection portions 432 are projection portions provided in the faces different from the face in which the misinsertion prevention upper face projection portion 140 and the misinsertion prevention lower face projection portion 141 are provided. Accordingly, with the cartridge 4A according to this embodiment, a rattling at the time of cartridge attachment can be more reliably suppressed by the above-described projection portions. It is therefore possible to secure adequate slidability while avoiding a situation where the misinsertion prevention upper face projection portion 140 and the misinsertion prevention lower face projection portion 141 erroneously interfere with the misinsertion prevention portions 671 of the plate 602 and the misinsertion prevention plate 160 without engaging therewith. Smooth attachment of the cartridge is thereby enabled, further increasing the attachability.

In the cartridge 4A according to this embodiment, the misinsertion prevention upper face projection portion 140 is arranged in the second wall 43 that is the upper face located on the vertically upper side, and the restriction front upper face projection portions 430 and the restriction front lower face projection portions 431 are arranged in the fourth wall 45 and the fifth wall 46 that are the side walls parallel with the attaching direction CS. Accordingly, the cartridge 4A according to this embodiment can suppress a tilt of the cartridge 4A in the width direction.

In the cartridge 4A according to this embodiment, the restriction front upper face projection portions 430 are arranged at a corner portion at which the second wall 43 serving as the upper face intersects the fourth wall 45 serving as the side wall, and at a corner portion at which the second wall 43 serving as the upper face intersects the fifth wall 46 serving as the side wall. Accordingly, the cartridge 4A according to this embodiment can more reliably suppress a tilt of the cartridge 4A in the width direction.

In the cartridge 4A according to this embodiment, the misinsertion prevention lower face projection portion 141 is arranged in the third wall 44 serving as the lower face located on the vertically lower side, and the restriction front upper face projection portions 430 and the restriction front lower face projection portions 431 are arranged in the fourth wall 45 and the fifth wall 46 serving as the side faces parallel with the attaching direction CS. Accordingly, the cartridge 4A according to this embodiment can also suppress a tilt of the cartridge 4A in the width direction from this aspect.

In the cartridge 4A according to this embodiment, the restriction front lower face projection portions 431 are arranged at a corner portion at which the third wall 44 serving as the lower face intersects the fourth wall 45 serving as the side wall, and at a corner portion at which the third wall 44 serving as the lower face intersects the fifth wall 46 serving as the side wall. Accordingly, the cartridge 4A according to this embodiment can also more reliably suppress a tilt of the cartridge 4A in the width direction from this aspect. In addition, in the case of obtaining the first case 401 and the second case 402 using a resin molding method, a mold need only be able to form the restriction front upper face projection portions 430 and the restriction front lower face projection portions 431 at the corner portions, and accordingly, the shape of the mold can therefore be simplified.

In the cartridge 4A according to this embodiment, the restriction rear projection portions 432 for restricting a tilt of the cartridge 4A in an intersecting direction that intersects the attaching direction CS are arranged in the third wall 44 serving as the lower face located on the vertically lower side, and on the trailing end side in the attaching direction CS. Accordingly, with the cartridge 4A according to this embodiment, the risk of occurrence of liquid leakage and a contact failure of the terminal can be reduced by suppressing a tilt of the cartridge along the vertical direction, as well as restricting the tilt using the restriction front upper face projection portions 430 and the restriction front lower face projection portions 431 on the side of the attachment end.

The above-described effects can also be achieved by any of the cartridges 4B to 4D.

Since the printer 10 according to this embodiment uses the already-described cartridges 4 in a state of being attached to the cartridge attachment portion 6, the attachability of the cartridges 4 is improved as a result of the limited parts such as the restriction front upper face projection portions 430 abutting against the already-described guide rails such as the first guide rail 650.

B. Modifications:

This invention is not limited to the above examples and embodiments, and may be implemented in various modes without departing from the gist of the invention. For example, the following modifications are also possible.

B-1. First Modification:

In the above embodiment, the printer 10 is an inkjet line printer. However, the printer 10 may be configured as an inkjet printer in which ink is discharged from an ink head installed in a carriage, while driving the ink head. At this time, the printer 10 may be a printer of a so-called "off-carriage type" in which the cartridge attachment portion 6 does not operate in conjunction with the movement of the carriage. Meanwhile, the invention is also applicable to a printer of a so-called "on-carriage type" in which the cartridge attachment portion 6 is provided in a carriage and moves together with the carriage.

B-2. Second Modification:

The invention is applicable not only to inkjet printers and the cartridges 4 thereof, but also to any printers (liquid ejection apparatuses) that eject liquid other than ink, and cartridges for containing this liquid. For example, the invention is applicable to various liquid ejection apparatuses such as those listed below and cartridges thereof.

(1) Image recording apparatuses such as a facsimile apparatus (2) Color material ejection apparatuses used to manufacture color filters for image display apparatuses such as a liquid crystal display (3) Electrode material ejection apparatuses used to form electrodes for organic EL (Electro Luminescence) displays, field emission displays (FED), and the like (4) Liquid ejection apparatuses that eject liquid containing biological organic matter used to manufacture biochips (5) Sample ejection apparatuses serving as precision pipettes (6) Lubricating oil ejection apparatuses (7) Resin solution ejection apparatuses (8) Liquid ejection apparatuses that eject lubricating oil to precision machines such as a watch and a camera (9) Liquid ejection apparatuses that eject transparent resin solution such as UV-cured resin solution onto substrates in order to form micro-hemispherical lenses (optical lenses) used in optical communication elements and the like

(10) Liquid ejection apparatuses that eject acid or alkaline etchant in order to etch substrates and the like

(11) Liquid ejection apparatuses including liquid ejection heads for discharging a very small amount of any other kinds of droplet The "droplet" refers to a state of the liquid discharged from a liquid ejection apparatus, and includes droplets having a granular shape, a tear-drop shape, and a shape having a thread-like trailing end. Furthermore, the "liquid" mentioned here need only be any kind of material that can be ejected by a liquid ejection apparatus. For example, the "liquid" need only be a material in a state where a substance is in a liquid phase, and a liquid material having a high or low viscosity, sol, gel water, and other liquid materials such as inorganic solvent, organic solvent, solution, liquid resin, and liquid metal (metallic melt) are also included in the "liquid". Furthermore, the "liquid" is not limited to being a single-state substance, and also includes particles of a functional material made from solid matter, such as pigment or metal particles, that are dissolved, dispersed, or mixed in a solvent, and the like. Representative examples of the liquid include ink such as that described in the above embodiment, liquid crystal, and the like. Here, the "ink" encompasses general water-based ink and oil-based ink, as well as various types of liquid compositions such as gel ink and hot melt-ink. When UV ink that can be cured by irradiating the UV ink with ultraviolet is contained in this cartridge and connected to a printer, a liquid containing portion is separate from the installation surface, and accordingly it is less likely that heat on the installation surface is transmitted to the liquid containing portion and cures the UV ink.

The invention is not limited to the above embodiment, examples, and modifications, and can be achieved by various configurations without departing from the gist thereof. For example, the technical features in the embodiments, examples, and modifications corresponding to the technical features in the modes described in the summary of the invention can be replaced or combined as appropriate in order to solve a part of or the entire problem described above, or in order to achieve some or all of the above-described effects. A technical feature that is not described as essential in the specification can be deleted as appropriate.

What is claimed is:

1. A cartridge configured to be attached to a liquid ejection apparatus having a holder to which the cartridge is to be attached, a guide rail that is provided in the holder and guides attachment of the cartridge, and an apparatus-side misinsertion prevention portion that prevents misinsertion of the cartridge, the cartridge comprising:

a liquid supply port for supplying liquid to the liquid ejection apparatus in a front end face formed in an intersecting direction that intersects an attaching direction;

a misinsertion prevention portion that engages with the apparatus-side misinsertion prevention portion; and a restriction portion that abuts against the guide rail and restricts a tilt of the cartridge in an intersecting direction that intersects an attaching direction in attachment status, wherein the restriction portion is arranged between a leading end side in the attaching direction and the misinsertion prevention portion, the restriction portion is positioned in a part of the surface extending in the attaching direction and intersecting the front end face and is positioned closer to the front end face than the misinsertion prevention portion.

2. The cartridge according to claim 1, wherein the misinsertion prevention portion is arranged on the leading end side in the attaching direction.

3. The cartridge according to claim 2, wherein a rear restriction portion that restricts a tilt of the cartridge in the intersecting direction is arranged in a lower face located on a vertically lower side, and on a trailing end side in the attaching direction.

4. The cartridge according to claim 1, wherein the restriction portion is arranged at a position closer to the misinsertion prevention portion than to the liquid supply port.

5. The cartridge according to claim 4, wherein a rear restriction portion that restricts a tilt of the cartridge in the intersecting direction is arranged in a lower face located on a vertically lower side, and on a trailing end side in the attaching direction.

6. The cartridge according to claim 1, wherein the restriction portion is a projection portion provided in a face different from a face in which the misinsertion prevention portion is provided.

7. The cartridge according to claim 6, wherein a rear restriction portion that restricts a tilt of the cartridge in the intersecting direction is arranged in a lower face located on a vertically lower side, and on a trailing end side in the attaching direction.

8. The cartridge according to claim 1, wherein the misinsertion prevention portion is arranged in an upper face on a vertically upper side, and the restriction portion is arranged in a side face parallel with the attaching direction.

9. The cartridge according to claim 8, wherein the restriction portion is arranged at a corner portion at which the upper face intersects the side face.

10. The cartridge according to claim 9, wherein a rear restriction portion that restricts a tilt of the cartridge in the intersecting direction is arranged in a lower face located on a vertically lower side, and on a trailing end side in the attaching direction.

11. The cartridge according to claim 8, wherein a rear restriction portion that restricts a tilt of the cartridge in the intersecting direction is arranged in a lower face located on a vertically lower side, and on a trailing end side in the attaching direction.

12. The cartridge according to claim 1, wherein the misinsertion prevention portion is arranged in a lower face on a vertically lower side, and the restriction portion is arranged in a side face parallel with the attaching direction.

13. The cartridge according to claim 12, wherein the restriction portion is arranged at a corner portion at which the lower face intersects the side face.

14. The cartridge according to claim 13, wherein a rear restriction portion that restricts a tilt of the cartridge in the intersecting direction is arranged in a lower face located on a vertically lower side, and on a trailing end side in the attaching direction.

15. The cartridge according to claim 12, wherein a rear restriction portion that restricts a tilt of the cartridge in the intersecting direction is arranged in a lower face located on a vertically lower side, and on a trailing end side in the attaching direction.

16. The cartridge according to claim 1, wherein a rear restriction portion that restricts a tilt of the cartridge in the intersecting direction is arranged in a lower face located on a vertically lower side, and on a trailing end side in the attaching direction.

17. The cartridge according to claim 1, wherein the restriction portion is extended in an attaching direction.

18. The cartridge according to claim 1, further comprising:

a cartridge fixation structure that includes a guide groove for guiding a locking pin of an apparatus fixation structure in liquid ejection apparatus, at least a part of the guide groove is opened in the attaching direction, wherein the cartridge fixation structure is for regulating a movement of the cartridge in a direction opposite to the insertion direction in cooperation with the apparatus fixation structure.

19. The cartridge according to claim 1, further comprising:

an air injection tube located in the first end face and configured to be connected with an air injection port of the liquid ejection apparatus, a second concave portion formed in the front end face, wherein the air injection tube located in a second concave portion.

20. The cartridge according to claim 1, further comprising:

an electrically conductive terminal configured and adapted to come into electrical contact with an apparatus side terminal unit in the liquid ejection apparatus;

a second restriction portion which restricts an positioning portion in the liquid ejection apparatus from moving in the intersection direction;

wherein the restriction portion are provided in a concave portion which is formed at least a part of the concave portion is opened in the attaching direction, the restriction portion are configured and adapted to receive insertion of the apparatus side terminal unit.

21. The cartridge according to claim 1, further comprising:

a first insertion hole positioned in first end face, a second insertion hole positioned in first end face, wherein the first insertion hole and the second insertion hole accept two attachment bars formed at the corresponding positon in the liquid ejection apparatus at the time of attachment.

22. A liquid ejection apparatus comprising:

a cartridge configured to be attached to a liquid ejection apparatus having a holder to which the cartridge is to be attached, a guide rail that is provided in the holder and guides attachment of the cartridge, and an apparatus-side misinsertion prevention portion that prevents misinsertion of the cartridge, the cartridge comprising:

a liquid supply port for supplying liquid to the liquid ejection apparatus;

a misinsertion prevention portion that engages with the apparatus-side misinsertion prevention portion; and a restriction portion that abuts against the guide rail and restricts a tilt of the cartridge in an intersecting direction that intersects an attaching direction at the time of attachment, wherein the cartridge has a rectangular shape, a distance between two opposing faces formed in an attaching direction is greater than a distance between the opposing faces formed in an intersecting direction that intersects the attaching direction in attachment status, wherein the restriction portion and the misinsertion prevention portion are provided on one of faces forming the rectangular cartridge and formed along the attaching direction.

23. The cartridge according to claim 22, wherein the restriction portion is arranged between a leading end side in the attaching direction and the misinsertion prevention portion, the restriction portion is positioned closer to the front end face than the misinsertion prevention portion.

* * * * *